US008206168B2

(12) United States Patent
Niitsu

(10) Patent No.: US 8,206,168 B2
(45) Date of Patent: Jun. 26, 2012

(54) TERMINAL ASSEMBLIES, CONNECTORS AND MANUFACTURING THEREOF

(75) Inventor: Toshihiro Niitsu, Tokyo (JP)

(73) Assignee: Molex Incorporated, Lisle, IA (US)

( * ) Notice: Subject to any disclaimer, the term of this patent is extended or adjusted under 35 U.S.C. 154(b) by 0 days.

(21) Appl. No.: 12/523,658

(22) PCT Filed: Jan. 18, 2008

(86) PCT No.: PCT/US2008/051514

§ 371 (c)(1),
(2), (4) Date: Nov. 17, 2009

(87) PCT Pub. No.: WO2008/089456

PCT Pub. Date: Jul. 24, 2008

(65) Prior Publication Data

US 2010/0120297 A1 May 13, 2010

(51) Int. Cl.
*H01R 13/15* (2006.01)
*H01R 13/62* (2006.01)

(52) U.S. Cl. ..... 439/260; 439/736

(58) Field of Classification Search ..... 439/260, 439/261, 495, 708, 736, 874, 329
See application file for complete search history.

(56) References Cited

U.S. PATENT DOCUMENTS

| | | | | |
|---|---|---|---|---|
| 4,505,529 | A | 3/1985 | Barkus | |
| 4,865,562 | A * | 9/1989 | Burg et al. | 439/395 |
| 5,248,262 | A | 9/1993 | Busacco et al. | |
| 5,364,284 | A | 11/1994 | Tohyama et al. | |
| 6,083,051 | A * | 7/2000 | Chang | 439/660 |
| 6,179,659 | B1 | 1/2001 | Moden | |
| 6,402,552 | B1 * | 6/2002 | Wagner | 439/606 |
| 6,796,852 | B2 * | 9/2004 | Okamoto | 439/736 |
| 6,896,546 | B2 | 5/2005 | Ichihara et al. | |
| 7,540,782 | B2 * | 6/2009 | Takahashi et al. | 439/630 |
| 2002/0061686 | A1 * | 5/2002 | Ma et al. | 439/736 |
| 2007/0037440 | A1 * | 2/2007 | Uchida et al. | 439/495 |
| 2007/0275601 | A1 * | 11/2007 | Takahashi et al. | 439/607 |
| 2010/0075529 | A1 * | 3/2010 | Niitsu | 439/377 |

FOREIGN PATENT DOCUMENTS

| | | |
|---|---|---|
| EP | 0396292 | 11/1990 |
| EP | 1394905 | 3/2004 |
| JP | 63-230383 | 3/1990 |
| JP | 02-045096 | 1/1992 |
| JP | 06-098204 | 10/1995 |
| JP | 07-025063 | 8/1996 |
| JP | 10-197475 | 1/2000 |
| JP | 11-230376 | 2/2001 |
| JP | 2004-055463 | 2/2004 |

OTHER PUBLICATIONS

International Search Report and Written Opinion, PCT Patent Application No. PCT/US2008/0051514. Oct. 17, 2008.

* cited by examiner

*Primary Examiner* — Hae Moon Hyeon
(74) *Attorney, Agent, or Firm* — Timothy M. Morella

(57) ABSTRACT

Terminal assemblies, connectors and methods of manufacturing the terminal assemblies are provided such that a plurality of elongated terminals are arranged in parallel at a pre-defined pitch and are partially enclosed by a terminal holding member, and in which the terminals are separated from one another during a material removal process.

16 Claims, 22 Drawing Sheets

60
61
62
65
68
68a
68b
68c
71
73a
73b
74
75
79
31
E
F
G
H

FIG.14A
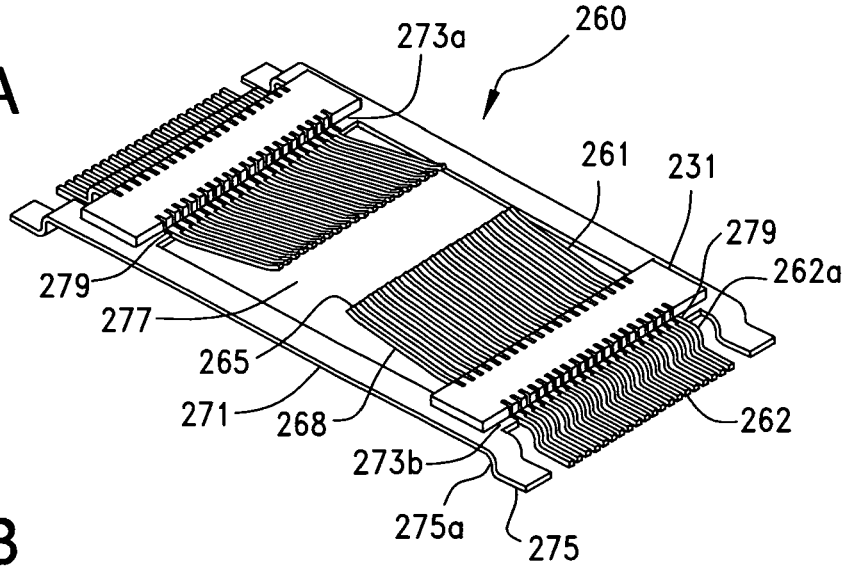
FIG.14B
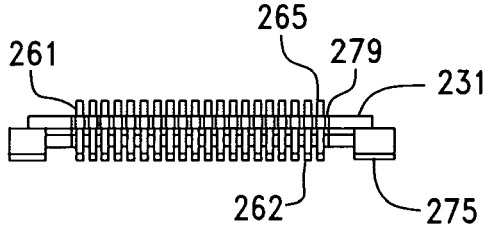
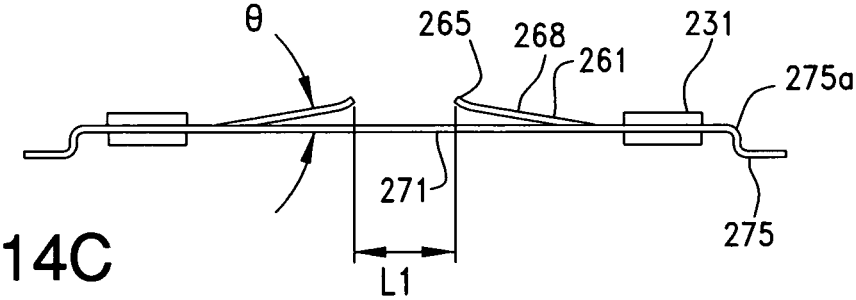
FIG.14C
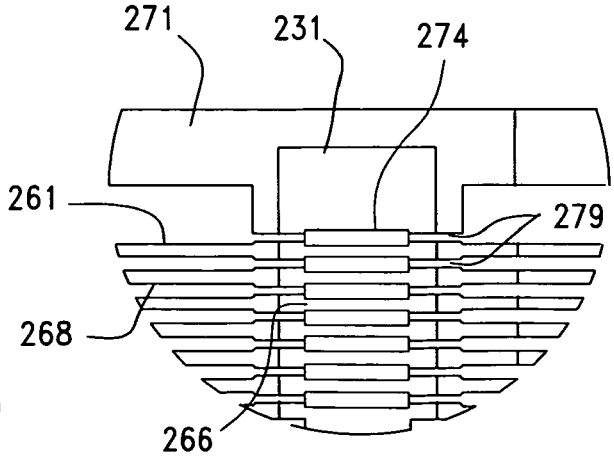
FIG.14D

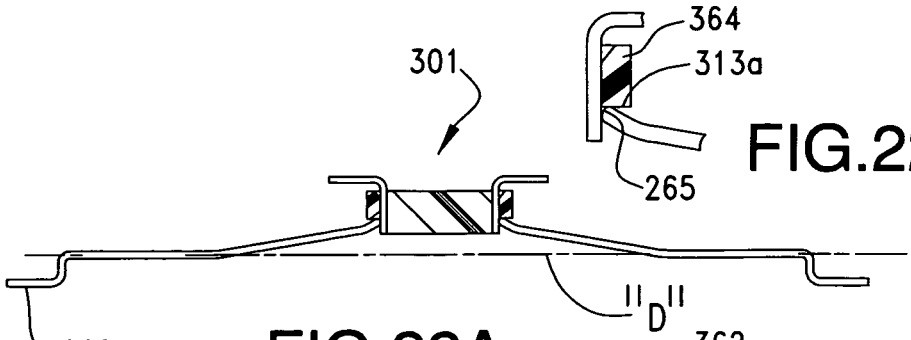
FIG.22A
FIG.22B
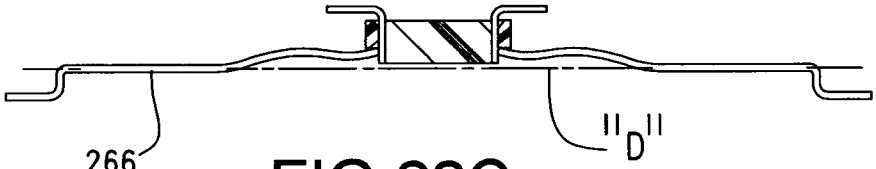
FIG.22C
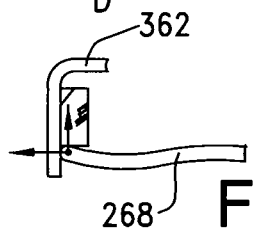
FIG.22D
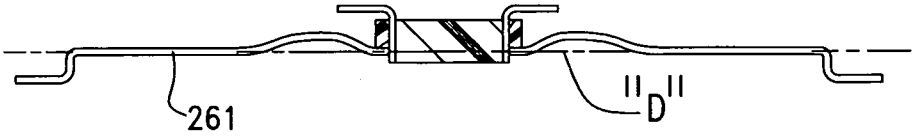
FIG.22E
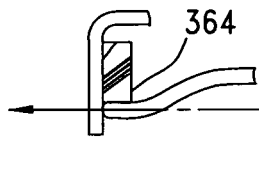
FIG.22F
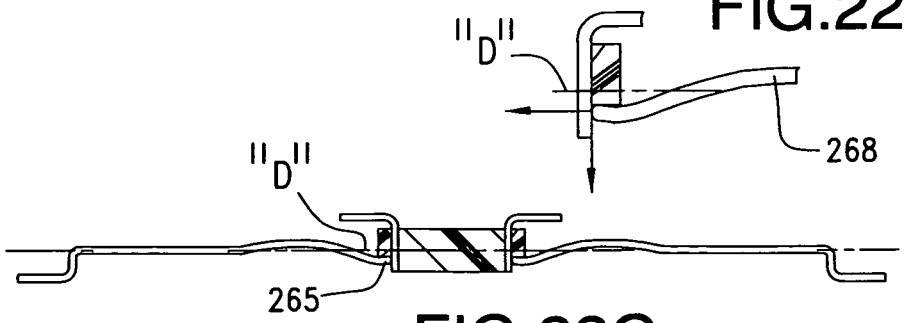
FIG.22G
FIG.22H FIG.23A
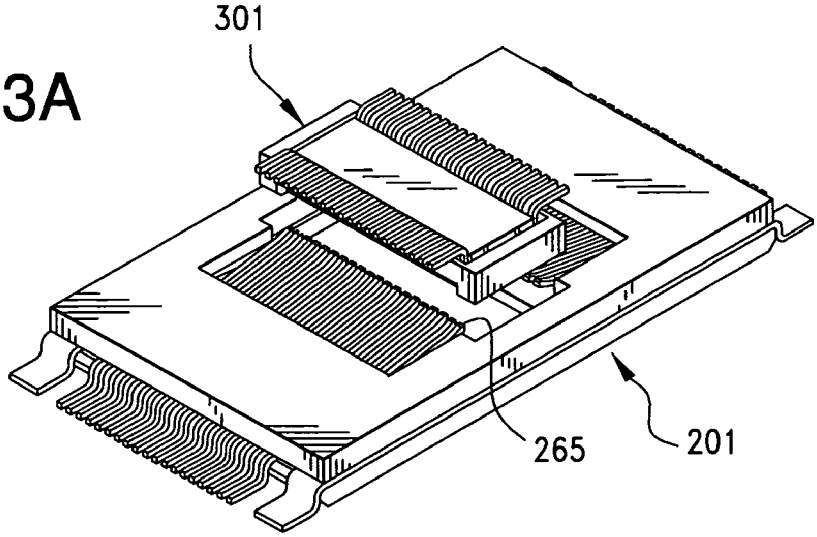
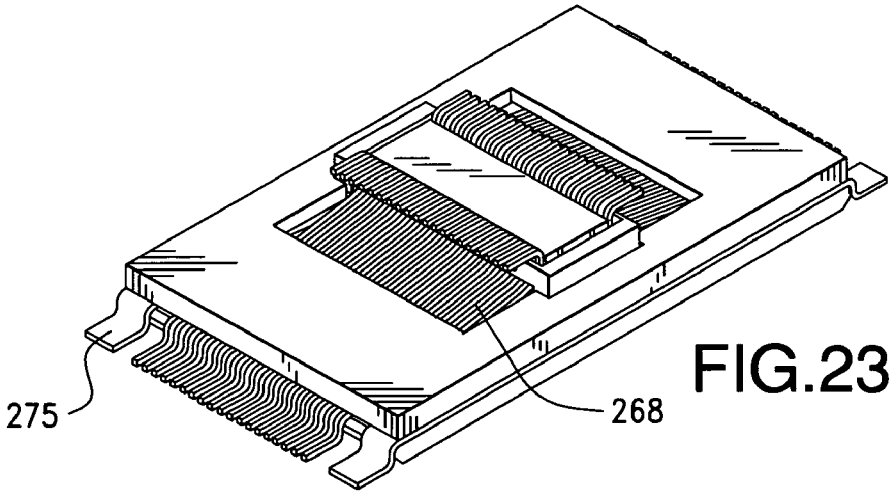
FIG.23B
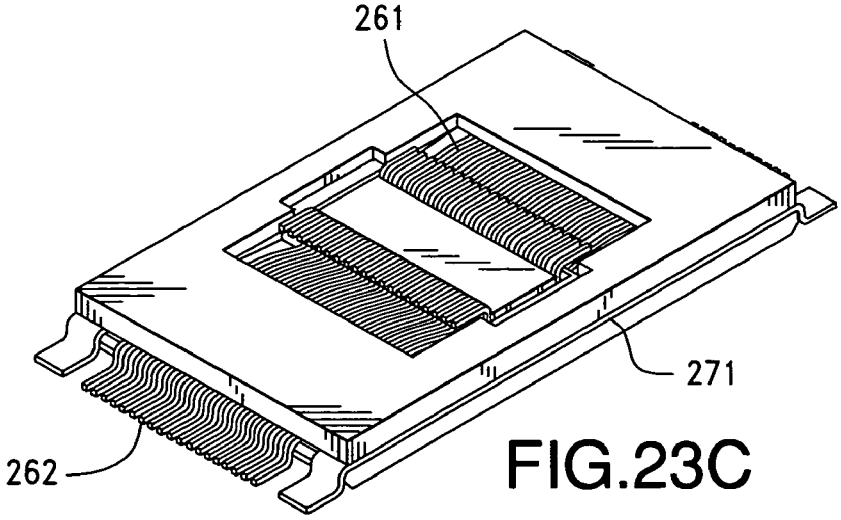
FIG.23C

TERMINAL ASSEMBLIES, CONNECTORS AND MANUFACTURING THEREOF

REFERENCE TO RELATED APPLICATIONS

The Present Disclosure is a U.S. National Phase Application of Patent Cooperation Treaty (PCT) Patent Application No. PCT/US2008/0051514, entitled "Terminal Assemblies, Connectors And Manufacturing Thereof," filed with the U.S. Patent and Trademark Office as Receiving Office for the PCT on 18 Jan. 2008. The PCT Application claims priority to prior-filed Japanese Patent Application No. 2007-009736, entitled "Terminal Assemblies, Connectors And Manufacturing Thereof," filed on 19 Jan. 2007 with the Japanese Patent Office (JPO); Japanese Patent Application No. 2007-009809, entitled "Terminal Assemblies, Connectors And Manufacturing Thereof," filed on 19 Jan. 2007 also with the JPO; and Japanese Patent Application No. 2007-012747, entitled "Terminal Assemblies, Connectors And Manufacturing Thereof," filed on 23 Jan. 2007 also with the JPO. The contents of each of the aforementioned Patent Applications are fully incorporated in their entireties herein.

BACKGROUND OF THE PRESENT APPLICATION

The Present Disclosure relates to terminal assemblies, connectors and methods for manufacturing the terminal assembly.

Conventional cable connecting connectors, such as flexible printed circuit (FPC) connectors and flexible flat cable (FFC) connectors, have been used to connect a flexible flat plate-like cables, referred to as flexible printed circuit substrates, flexible flat cables or the like (see, e.g., Japanese Patent Application No. 2001-057260).

FIG. 28 is a cross-sectional view showing a conventional cableconnecting connector. This connector has an insulating housing 701, with a first conductive terminal 702 and a second conductive terminal 703 held by the housing 701. The first terminal 702 is inserted into a slit disposed in the housing 701 from a cable insertion port, when attached. The second terminal 703 is also inserted into a slit disposed in the housing 701 from a side opposite to the cable insertion port, when attached. Moreover, an insulating actuator 704 is disposed on an upper surface of the housing 701. The actuator 704 is rotatably attached to the housing 701 and rotated between a shown closed position and an opened position (not shown). That is, the actuator 704 rotates due to such a configuration that opposite ends thereof are supported by the housing 701 and an intermediate portion thereof is supported by the first terminal 702. When the actuator 704 is at its opened position, a flat-plate-like cable 705 is inserted from an opening of the housing 701. Moreover, when the cable 705 is inwardly inserted into a distal end, an operator can rotate the actuator 704 to its closed position. A lock portion 706 of the actuator 704 is then brought into engagement with a lock portion (not shown) of the housing 701 to lock the actuator 704. Thus, the cable 705 is pressed from above by the actuator 704, and a plurality of connecting portions exposed on a lower surface of the cable 705 come into contact with the first terminal 702 and the second terminal 703 to conduct electricity to the respective terminals, the actuator 704 being in a fixed position.

Moreover, the cable 705 is sometimes drawn around and positioned so as to extend in a direction vertical to a mounting surface (a direction shown by the arrow in FIG. 28). Even in such a case, a distance from the lock portion 706 to a rotation center 707 of the actuator 704 is longer than that from a point

708 of the actuator 704 at which a tensile force is received to the rotation center 707. Therefore, owing to the principle of leverage, engagement of the lock portion 706 of the actuator 704 with the lock portion of the housing 701 is not released, preventing the cable 705 from being drawn around to cause undesired release of the actuator 704.

Nevertheless, in the conventional connector of FIG. 28, since the first terminal 702 and the second terminal 703 are inserted into and seated at the respective slits provided in the housing 701, achieving a reduction in a pitch of arrangement of the terminals is restricted. Where a reduction in terminal pitch is desired in such an arrangement, there would be an attempt to reduce the widths of the first and second terminals 702 and 703. When such small width first and second terminals 702 and 703 are produced from a metallic material, there are workability limits to thicknesses of terminal production materials. Thus, it is difficult to set the thicknesses of the terminals so as to obtain a sufficient spring force, that is, sufficient pressing forces of the first and second terminals 702 and 703 with respect to the cable 705. Therefore, as a result, there is a restriction on the ability to reduce the pitch of the first and second terminals 702 and 703.

Furthermore, a complicated structure of the housing 701 and actuator 704 would be needed since the lock portion 706 of the actuator 704 is configured to be engaged with the lock portion (not shown) of the housing 701, thereby fixing the posture of the actuator 704. When the actuator 704 is rotated toward an inlet end of the opening of the housing 701, the actuator is brought into the closed position thereof. Therefore, in a case where the actuator is applied to a so-called straight type of connector mounted so that the opening of the housing 701 is positioned vertically to a substrate, operability must deteriorate, and the height of the connector will increase. Furthermore, it is difficult to reduce the pitch of the first and second terminals 702 and 703.

Other conventional connectors electrically connect a pair of electric or electronic components such as circuit substrates to each other (see, e.g., Japanese Patent Application Publication No. 2004-55463) include connector portions which are attached to respective surfaces of a pair of circuit substrates facing each other and which protrude from the respective surfaces toward one another.

FIG. 29 is a cross-sectional view of another conventional connector. This shows a first connector 801 attached to one circuit substrate (not shown), and a second connector 811 attached to the other circuit substrate (not shown). The first connector 801 includes a plurality of first terminals 802, and the second connector 811 includes a plurality of second terminals 812. Moreover, when the first connector 801 and the second connector 811 are mutually fitted together so as to permit the first and second connectors to be in contact with one another, connection is provided between a pair of circuit substrates.

In FIG. 29, an attachment protruding portion 803 is press-fitted in an attachment hole of the first connector 801 to fixedly secure the first terminals 802 to the first connector 801. Moreover, a tail portion 804 of each first terminal 802 is connected to a wiring line formed on the surface of the one circuit substrate by soldering. The second connector 811 is formed by over-molding so as to coat a part of the second terminals 812. Moreover, a tail portion 813 of each second terminal 812 is connected to a wiring line formed on the surface of the other circuit substrate by soldering.

Furthermore, when the first connector 801 is fitted to the second connector 811, a connection protrusion 806 at a tip end of a connecting portion 805 of each first terminal 802 comes into contact with a connection concave portion 815 formed at a connecting portion 814 of each second terminal 812 to electrically connect a pair of circuit substrates to each other. The connection protrusion 806 is brought into association with the connection concave portion 815 to mutually lock the first terminals 802 and the second terminals 812 to retain the first and second connectors 801 and 811 fitted together.

However, in these types of conventional connectors, when each connection protrusion 806 functions as a spring elastically displaced in a direction orthogonal to a fitting direction (the vertical direction in FIG. 29), electric contact between the first terminals 802 and the second terminals 812 is securely maintained. Moreover, the fitted state between the first and second connectors 801 and 811 is maintained. Therefore, the shape of the first terminals 802, including the connecting portions must be complicated since the length of the elastically deformed connecting portion 805 must be increased to obtain a sufficient spring length, especially when there is a desire to reduce the thickness of the connector while securing sufficient spring length.

Moreover, the first terminals 802 are usually die-cut and formed in order to exert a sufficient spring force. However, in this case, the individual first terminals 802 need to be press-fitted in the attachment hole of the first connector 801 one by one, when being attached. Therefore, costs increase. Furthermore, in the attachment hole, a wall is formed between the terminals in order to provide an electric insulation between the neighboring first terminals 802 and therefore it becomes difficult to reduce pitch therebetween.

Other connectors for electrically connecting a pair of electric or electronic components to each other or to connect the electric or electronic component to a circuit substrate include a plurality of elongated terminals arranged in parallel with one another (see, e.g., Japanese Patent Application Publication No. 7-282912).

FIG. 30 is a diagrammatic plan view illustrating a further conventional terminal assembly, which is in the middle of manufacture thereof, reference numeral 901 generally denoting a plurality of terminals to be mounted in a connector housing (not shown) in parallel arrangement with one another. One longitudinal end of each terminal 901 is a contact portion 902 which is provided to contact a counterpart terminal (not shown), and the other end of each terminal is a tail portion 903 connected to a circuit substrate or the like (not shown).

A carrier portion 905 is integrally connected to tip ends of the respective tail portions 903. In the process of manufacturing this connector or the terminal assembly, the carrier portion 905 is grasped by a conveying or transferring machine, a machine tool, a working tool, a jig, an operator's hand or the like in order to readily perform operations such as conveying or transferring and positioning of the terminal assembly, and the carrier portion 905 is cut and removed in a final manufacturing stage of the connector assembly.

Furthermore, the terminals 901 are connected to each other via a sub-carrier portion 904 at a portion between the contact portion 902 and the tail portion 903. Therefore, during the manufacturing of the terminal assembly, an arrangement of the terminals 901 can be accurately maintained.

In addition, an insulating resin material 906 is provided so as to coat entire connecting portions of the terminals 901 to the sub-carrier portions 904 and a surrounding area of the connecting portions. The insulating resin material member 906 is integrally formed by insert molding of portions of the terminals 901 between the contact portions 902 and the tail portions 903, and the terminals 901 are fixed and held.

Here, the insulating resin material member 906 has a plurality of window portions 907 formed during the insert molding. Each window portion 907 is formed at a position corresponding to the sub-carrier portion 904 between the adjacent terminals 901. Therefore, in a post-process, the sub-carrier portions 904 exposed in the window portions 907 can be removed by die-cutting. It is to be noted that the carrier portion 905 is similarly cut off in the post-process. Hence, the terminals 901 are held by the insulating resin material member 906 in a state in which the terminals 901 are electrically independent from each other, but physically connected to one another. Instead of the window portions 907, cutout portions may be formed in the insulating resin material member 906.

However, in this conventional terminal assembly of FIG. 30, the window portions 907 or the cutout portions are formed during the molding of the insulating resin material member 906.

Therefore, in a cavity of a die for molding the insulating resin material member 906, convex portions corresponding to the window portions 907 or the cutout portions must be provided, requiring a complicated die. When the terminal assembly is used in, for example, the connector of a small-sized electronic device such as a cellular phone, an interval between the adjacent terminals 901 is about 1 [m] or less. Providing convex portions corresponding to the small window portions 907 or the cutout portions formed in such a small place is very difficult. Furthermore, the sub-carrier portions 904 exposed in the window portions 907 or the cutout portions are die-cut and removed. It is extremely difficult to prepare a metallic piece or tool which is able to enter the above-described small window portions 907 or the cutout portions to remove the sub-carrier portions 904 by the die-cutting.

SUMMARY OF THE PRESENT APPLICATION

To solve the above problems encountered by the above-described conventional terminal assemblies, an object of the Present Disclosure is to provide a terminal assembly, a connector and a manufacturing method of the terminal assembly in which a preliminarily formed terminal product having terminals integrally connected to one another via a sub-carrier portion is formed, followed by forming a terminal holding member to coat and enclose at least a part of the sub-carrier portion, and both a part of the sub-carrier portion and a part of the terminal holding member are finally cut off to separate the terminals to be individual from one another. Hence, even if a considerably narrow pitch is desired, the terminal assembly and the connector can easily be manufactured in a short time while surely maintaining an accurate arrangement of the terminals, and in addition, the total sized of the terminal assembly and the connector can be reduced.

In addition, in a terminal assembly according to a further embodiment of the Present Disclosure, the arm portion comprises a first angled portion connected to the base end portion and a second angled portion connected to the first angled portion via the peak portion, and the first angled portion and the second angled portion form an obtuse angle of the peak portion.

In a terminal assembly according to still another embodiment, the terminal holding member is a member formed of an insulating material by an over-molding so as to coat at least a part of both the base end portions and the frame members.

In a connector according to still another embodiment of the Present Disclosure, a cable fixing movable member is mounted on the housing, a position of the cable fixing movable member being changed between a first position where the flat plate-like cable is capable of being inserted or extracted and a second position where the flat plate-like cable is securely fixed, and the cable fixing movable member comes in contact with the peak portion of each terminal at the second position to thereby enlarge the angle of the peak portion.

In a connector according to still another embodiment of the Present Disclosure, the housing has an opening formed at a center thereof in a longitudinal direction thereof, permitting the counterpart connector to fit therein, and the terminals include two sets of terminals arranged so that the base end portions are positioned on opposite sides of the housing in the longitudinal direction and so that the tip end portions are directed to the center of the housing in the longitudinal direction and positioned in the opening.

According to another embodiment of the Present Disclosure, the manufacturing method of the terminal assembly is characterized in that the slits are formed so as to close opposite ends thereof in the extension direction, the terminal holding member is formed so as to coat at least the whole slits, and a part of the terminal holding member is cut together with the portion of the sub-carrier portion which closes the ends of the slits.

In accordance with an embodiment, the terminal assembly is manufactured by forming the preliminarily formed terminal product having the terminals arranged at the predetermined pitch to be parallel with one another and integrally connected to one another via the sub-carrier portion; forming the terminal holding member which coats at least a part of the sub-carrier portion; and cutting a part of both the sub-carrier portion and the terminal holding member to separate the terminals independently of one another. Hence, even the terminal assembly having a minute pitch can easily be produced in a short period of time, an arrangement of the terminals can accurately be maintained, and the terminal assembly can be made small in its entire size.

The connectors of the Present Disclosure provide a reduction in size heretofore unseen in the art. Multiple embodiments are disclosed in the application to follow. Illustrated embodiments include what are referred to herein as the first and second embodiments. These take the form of a reduced size connector for flat flexible circuitry (FFC, FPC and the like), shown in FIGS. 1-9 and 24-27. What is referred to herein as the third embodiment takes the form of a board-to-board connector is shown in FIGS. 10-23.

BRIEF DESCRIPTION OF THE FIGURES

FIG. 2 is a multiple view of the connector first embodiment, in which

FIG. 4 is a diagrammatic view illustrating the manufacturing steps of a terminal assembly according to the first embodiment, in which

FIG. 5 is a diagrammatic view illustrating the manufacturing steps of the terminal assembly according to the first embodiment, in which

FIG. 6 is a diagrammatic view illustrating the terminal assembly according to the first embodiment, in which

FIG. 11 is a complex view having two side views, and a cross-sectional view illustrating the connector according to the third embodiment, in which

FIG. 12 is a diagrammatic view illustrating the manufacturing steps of the terminal assembly according to the third embodiment, in which

FIG. 13 is a diagrammatic view illustrating the manufacturing steps of the terminal assembly according to the third embodiment, in which

FIG. 14 is a diagrammatic view of the terminal assembly according to the third embodiment, in which FIG. 14A is a perspective view, FIG. 14B is a front view, FIG. 14C is a side view, and FIG. 14D is an enlarged plan view of the main part;

FIG. 20 is a diagrammatic view showing a case where the connector and the counterpart connector are mounted on a circuit substrate according to the third embodiment, in which FIG. 20 is a side view and FIG. 20A is an enlarged plan view of a portion of the side view;

FIG. 22 is a series of diagrammatic views showing the effects of the contact and mating forces during the operation of fitting the connector into the counterpart connector according to the third embodiment, in which FIGS. 22A, 22C, 22E and 22G show a progression of the connector mating with the terminal assembly from the point of first contact through the point of full mating, and FIGS. 22B, 22D, 22F and 22H show the force vectors of the contact and mating forces at the point in which the terminal is in contact with the connector;

FIG. 23 is a series of perspective views showing an operation of fitting the connector into the counterpart connector according to the third embodiment, in which FIG. 23A corresponds to FIG. 17, FIG. 23B corresponds to FIG. 18 and FIG. 23C corresponds to FIG. 19;

DESCRIPTION OF THE PREFERRED EMBODIMENTS

Figure 1:
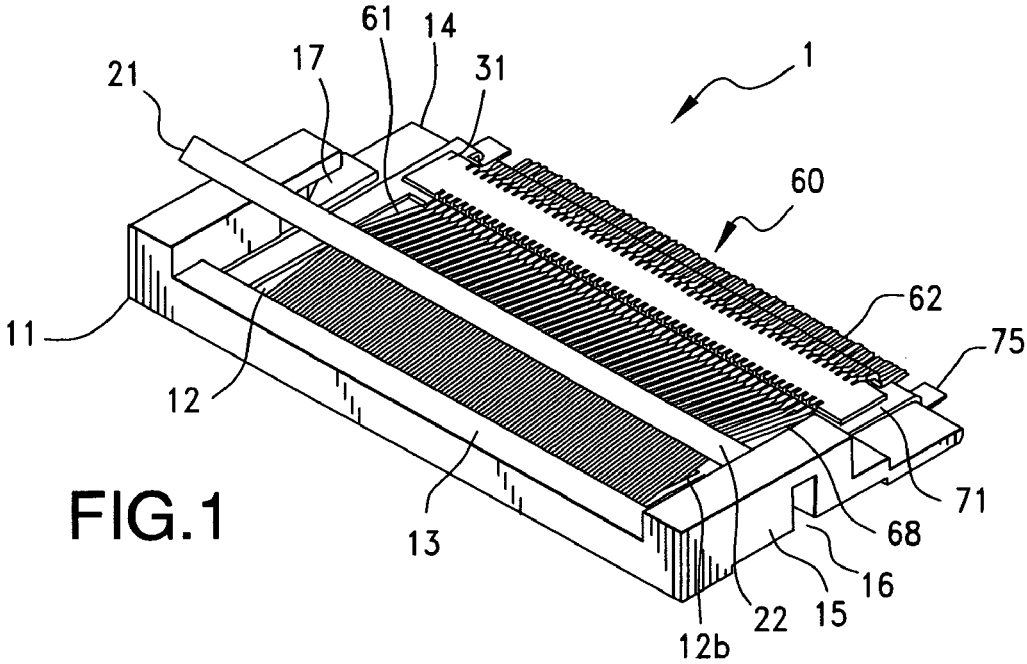
FIG. 1 is a perspective view of a connector according to a first embodiment.

As required, detailed embodiments of the Present Disclosure are disclosed herein; however, it is understood that the disclosed embodiments are merely exemplary of the Present Disclosure, which may be embodied in various forms. Therefore, specific details disclosed herein are not to be interpreted as limiting, but merely as a basis for the Claims and as a representative basis for teaching one skilled in the art to variously employ the Present Disclosure in virtually any appropriate manner, including employing various features disclosed herein in combinations that might not be explicitly disclosed. Embodiments of the Present Disclosure will be described hereinbelow in detail with reference to the accompanying Figures. In connectors of the Present Disclosure, each terminal may have a width (illustrated at "W" in FIG. 1A) of about 0.05 mm and each of the spaces between the terminals also has a spacing (illustrated at "S" in FIG. 1A) of about 0.05 mm so as to provide a terminal pitch (center to center spacing, shown as "P" in FIG. 1A) of between about 0.1 and about 0.2 mm, typically between about 0.1 and about 0.15 mm, usually about 0.1 mm. This is further accomplished in a very small package, or footprint, with connectors of the first and second embodiments (that shown in FIGS. 1-9 and FIGS. 24-7) desirably having dimensions of about 4.5 mm wide by about 2.5 mm deep and about 0.5 mm high. The height between the circuit board and the top of the actuator 21, in the position shown in FIG. 2(*c*) will preferably be 1.6 mm. In the second embodiment of the Present Disclosure, of the board-to-board variety shown in FIGS. 10-23, the connector housing has a depth of around 5 mm and a width of 3.2 mm while maintaining a height of the receptacle of about 0.5 mm.

In FIGS. 1, 2A-C, reference numeral 1 is a connector according to a first embodiment, having a terminal assembly 60 described later. While connector 1 may be of any type, the illustration herein shows a case where the connector is an example of a cableconnecting connector mounted on a substrate such as a circuit substrate (not shown) for use in electrically connecting, to the substrate, a flat-plate-like cable 101 referred to as a flexible printed circuit (FPC), a flexible flat cable (FFC) or the like as described later.

This illustrated connector 1 is preferably of a so-called straight type, and a flat-plate-like cable 101 as a cable is inserted substantially vertically to the substrate. That is to say, it is assumed that the connector 1 is mounted so that a cable insertion opening into which the flat-plate-like cable 101 is to be inserted is directed upwards. It is to be noted that the flat-plate-like cable 101 is a flat-plate-like flexible cable referred to as, for example, the FPC, the FFC or the like, but the flat-plate-like cable may be of any type as long as the cable is provided with conductor wires as counterpart terminals (not shown). The cable is also applicable to a printed wiring board usually referred to as a rigid substrate.

Representations herein of directions such as up, down, left, right, front, rear, and the like, used for explaining structure and movement are not absolute, but relative. These representations are appropriate when the connectors are positioned as shown in the drawings. If the position of any such connector changes, it is understood that these representations are to be changed according to the change of position.

Figure 1A:
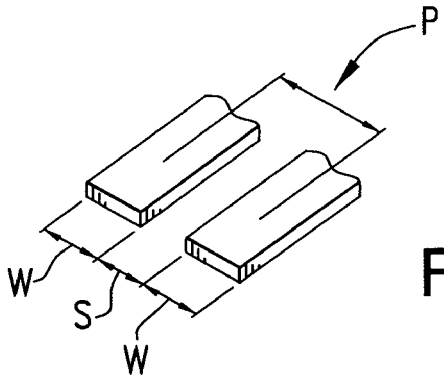
FIG. 1A is a detailed perspective view taken from FIG. 1, showing portions of adjacent terminals and the spacing and pitch thereof.
Figure 3:
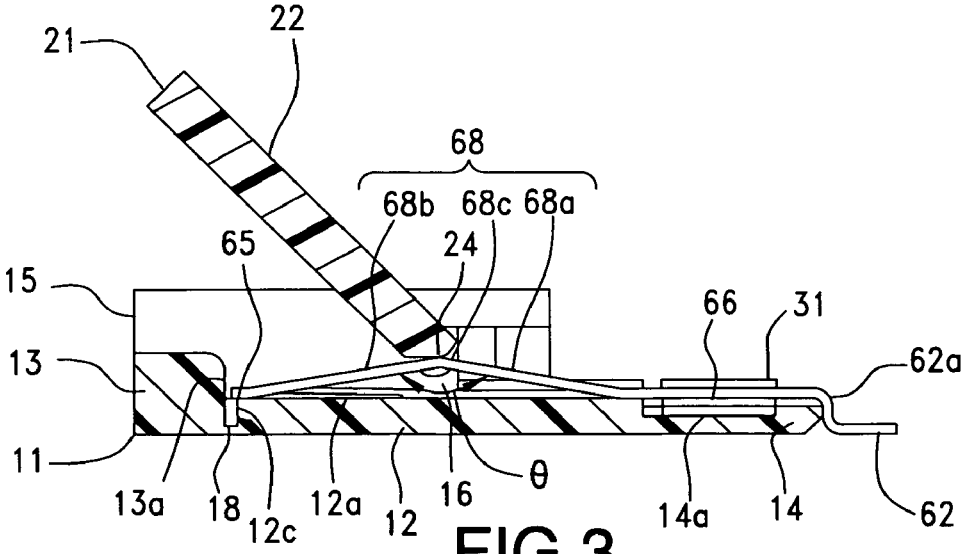
FIG. 3 is a cross-sectional view of the connector first embodiment, taken along the Z-Z arrow of FIG. 2B.
Figure 2A:
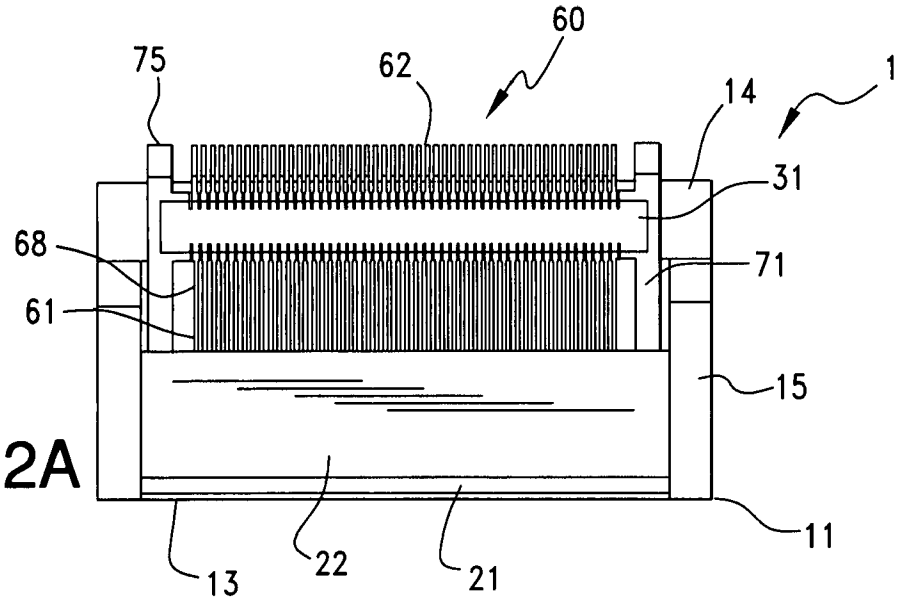
FIG. 2A is a top plan view.
Figure 2B:
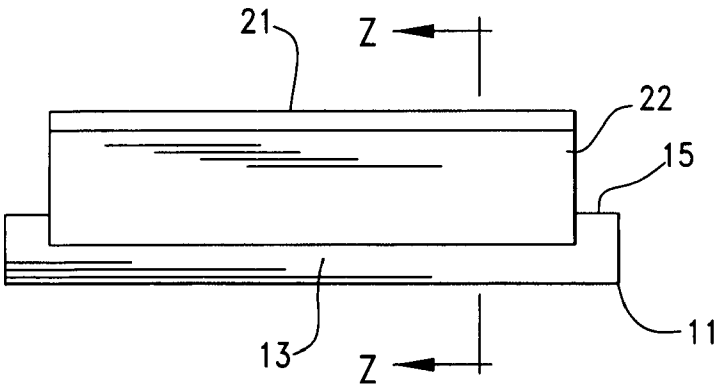
FIG. 2B is a rear view.
Figure 2C:
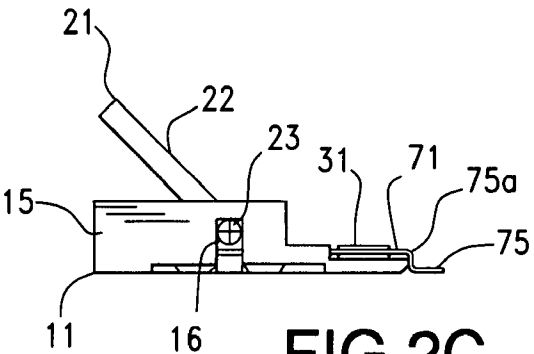
FIG. 2C is a side view.

Connector 1 has a housing 11 as a connector main body integrally made and formed of an insulating material such as a synthetic resin, an actuator 21 as a cable fixing movable member mounted on the housing 11, and a plurality of terminals 61 made and formed of a conductive metal. The actuator 21 is mounted on the housing 11 so that the position of the actuator 21 is changeable between an opened position thereof (as a first position) where the flat-plate-like cable 101 can be inserted or extracted and a closed position thereof (as a second position) where the inserted flat plate-like cable 101 is fixedly secured. The illustrated actuator 21 has a substantially rectangular flat plate-like operating portion 22, an operation surface 24 which performs a function of a cam formed at one edge of the operating portion 22 in a short or lateral direction, and a rotary shaft portion 23 extending outwards from opposite sides of the above-mentioned one edge. FIGS. 1-3 show a state in which the actuator 21 is brought to the opened position thereof.

Illustrated housing 11 has a substantially rectangular flat plate-like base portion 12, a thick plate-like inner wall portion 13 extending along one edge of the base portion 12 in the short or lateral direction, a thin plate-like terminal fixing portion 14 which extends along the other edge of the base portion 12 in the short or lateral direction, and thick plate-like side wall portions 15 which extend along opposite edges of the base portion 12 in a longitudinal direction, respectively. An inner side surface of each side wall portion 15 is provided with a rotary shaft receiving opening 16 which rotatably holds the rotary shaft portion 23 of the actuator 21, and a slide groove 17 which communicates with the rotary shaft receiving opening 16. The actuator 21 is rotatably attached to the base portion 12 in a state in which the rotary shaft portion 23 is guided into the slide groove 17 and stored in the rotary shaft receiving opening 16.

An upper surface of the terminal fixing portion 14 is provided with an accommodating recessed portion 14*a* in which a terminal holding member 31 is stored. At a portion of the upper surface of the base portion 12, close to the inner wall portion 13, a plurality of guide protrusions 12*a* are provided that extend in an extension direction of the terminals 61. Respective neighboring guide protrusions 12*a* define a gap that functions as a terminal guide groove 12*b* in which a tip end portion 65 of each terminal 61 is received. Housing 11 is mounted so that a lower surface of the base portion 12 faces a mounting surface of the substrate.

A cable-accommodating concave portion or slot 18 into which a tip end portion of the flat plate-like cable 101 is inserted is formed between the base portion 12 and the inner wall portion 13. This slot 18 extends at an angle, preferably generally perpendicular, to the direction in which the terminals 61 extend.

Each terminal 61 is an elongated strip-like member made and formed of a metal plate having elasticity, and extends in the short or lateral direction of the housing 11, namely, from the terminal fixing portion 14 to the inner wall portion 13. The longitudinally-arranged terminals 61 are at a predetermined pitch (e.g., about 100 μm or less) in parallel with one another, and attached to the terminal fixing portion 14 of the housing 11. Terminals 61 typically are made of metals having a spring property, such as phosphor bronze, a copper-beryllium alloy or the like. Some materials for connector terminals tend to display weak pressing forces against the counterpart terminals when same are thinned and miniaturized. According to the Present Disclosure, a necessary pressing force can be secured even if such a general material is used for forming the terminals having the fine or thin profile or shape. A slit-like gap is formed between the terminals 61. The terminals 61 are arranged so that base end portions 66 are substantially positioned on the terminal fixing portion 14 of the housing 11 and so that the tip end portions 65 face the inner wall portion 13 of the housing 11 and are positioned in the terminal guide groove 12*b* in the upper surface of the base portion 12. It is to be noted that the tip end portions 65 are arranged at a position adjacent to the cable accommodating concave portion 18, that is at substantially the same position as that of the inner end surface 12*c* of the base portion 12 in the lateral direction of the housing 11 so that the tip end portions 65 do not substantially protrude from the inner end surface 12*c* to the cable accommodating concave portion 18.

Specifically, as shown in FIG. 3, the base end portions 66 are arranged one after another in the longitudinal direction of the housing 11 so as to be in parallel with one another and held by the terminal holding member 31 integrally formed of an insulating material such as a synthetic resin; arm portions 68 extend from the base end portions 66 to the center of the housing 11 in the longitudinal direction and have a centrally raised portion in a triangular shape thereof when viewed from the side; the tip end portions 65 which are free ends of the arm portions 68; and tail portions 62 as soldered portions extending from a side opposite to the arm portions 68 of the base end portions 66 and protruding outwards from the terminal fixing portion 14 of the housing 11. It is to be noted that the tail portions 62 are connected to the surface of the substrate (not shown) by soldering or the like. Therefore, each tail portion 62 is connected to the base end portion 66 via a crank-like stepped portion 62*a* so that a lower end surface is disposed to be substantially even with the lower surface of the terminal fixing portion 14.

Here, each arm portion 68 includes a first angled portion 68*a* connected to the base end portion 66, a second angled portion 68*b* peaked at a predetermined angle with respect to the first angled portion 68*a*, and a peak portion 68*c* as a portion which connects the first angled portion 68*a* to the second angled portion 68*b*. The first angled portion 68*a* obliquely extends upwards from the base end portion 66 to the peak portion 68*c*, the second angled portion 68*b* obliquely extends downwards from the peak portion 68*c* to the tip end portion 65, and the peak portion 68*c* protrudes to come above the base end portion 66 and the tip end portion 65. It is to be noted that an angle of the peak portion 68*c*, namely, an angle (A) formed by the first angled portion 68*a* and the second angled portion 68*b* can approach being linear or flat (180 degrees) but not more than 180 degrees, and in any event sufficient to form a peak to provide functions noted herein. This peak angle can arbitrarily be set, but it is typical that the angle is between about 90 to about 180 degrees ($90° < \theta < 180°$), namely, an obtuse angle. When the obtuse angle is formed, a force of the terminals in the longitudinal direction can more efficiently be used. A ratio of a length of the first angled portion 68*a* to that of the second angled portion 68*b* can arbitrarily be set, such as between 1:2 and 2:1, but a ratio of approximately 1:1 is typical. In a case where the ratio is 1:1, a stress which acts on the first angled portions 68*a* and the second angled portions 68*b* becomes uniform at a time when the arm portions 68 are pressed against the conductor wires of the flat plate-like cable 101 as counterpart terminals. Therefore, the arm portions 68 can come into stable contact with the wires.

In this illustrated arrangement, each peak portion 68*c* contacts the operation surface 24 of the actuator 21. When the actuator 21 moves from the opened position to the closed position, the peak portion 68*c* is depressed by the operation surface 24. When the peak portion 68*c* is depressed, the tip end portion 65 (as the free end of the arm portion 68) moves toward the inner wall portion 13 to protrude from the inner end surface 12*c* to the cable accommodating concave portion 18, and is pressed by the conductor wire of the flat plate-like cable 101 inserted into the cable accommodating concave portion 18. When the actuator 21 contacts and depresses the peak portion 68*c*, the angled portions 68*a*, 68*b* extend longitudinally.

Terminal holding member 31 is preferably formed by over-molding (i.e., integral molding conducted by the injection molding) so as to enclose the base end portions 66 from above and below. Thus, the terminal holding member 31 has an elongated rectangular parallelepiped shape extending in a direction in which the terminals 61 are arranged one after another, namely, in the longitudinal direction of the housing 11, and integrally holds all the base end portions 66 arranged one after another in the above-mentioned direction. A portion of the terminal holding member 31 below the base end portions 66 is received in the accommodating recessed portion 14*a* formed in the terminal fixing portion 14. The terminal holding member 31 is secured to the terminal fixing portion 14 by an adequate securing means such as an adhesive. Therefore, the base end portions 66 are held by the housing 11 via the terminal holding member 31.

In addition, frame members 71 made of a metal are attached to opposite ends of the housing 11 in the longitudinal direction in a manner such that the frame members 71 extend in a direction vertical to the longitudinal direction, i.e., in the lateral direction. The frame members 71 are secured to the housing 11 via a securing means such as an adhesive, and a part of the frame members 71 is held by the terminal holding member 31 by the over-molding. An end of the frame member 71, which is located on a side adjacent to the terminal fixing portion 14, is an attaching portion 75 which protrudes outwards from the terminal fixing portion 14. When the attaching portion 75 is connected to the surface of an associated substrate by soldering or the like, the attaching portion 75 is connected to the substrate via a crank-like stepped portion 75*a* so that a lower end surface of the attaching portion is disposed at substantially the same position as that of the lower surface of the terminal fixing portion 14 in the same manner as in the tail portion 62. Hence, the terminal holding member 31 can function as an auxiliary attachment fitting member for fixedly securing the connector 1 to the surface of the substrate.

The slots, or slits 74 of this first embodiment, of the subcarrier 73, provide a sacrificial skeletal network with enclosed openings that permit the passage of molding material therebetween and therearound. This skeletal network includes lengthwise body portions of the terminals 61, that are maintained in spaced apart order (or pitch) by what may be considered to be interconnecting bridging portions, such as first and second terminal connecting portions 73*a* and 73*b* in FIGS. 4B-D. Such bridging portions form two continuous rails that serve to space the terminals apart.

Figure 4A:
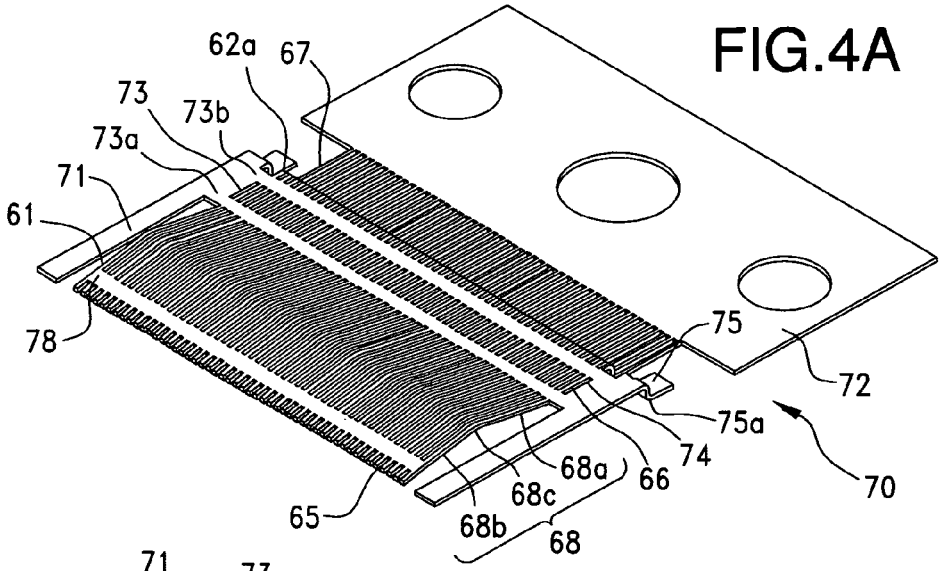
FIG. 4A is a first perspective view of elements to be used for the manufacture.
Figure 4B:
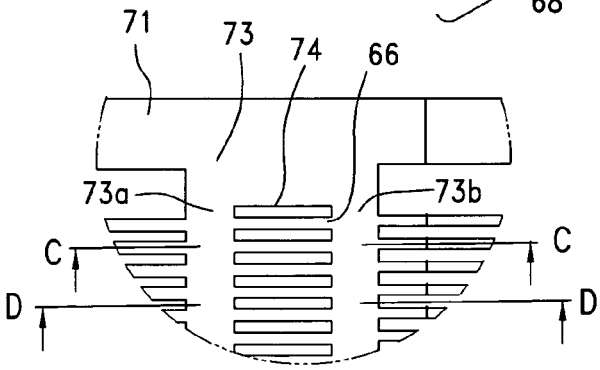
FIG. 4B is an enlarged plan view of a main part.
Figure 4C:
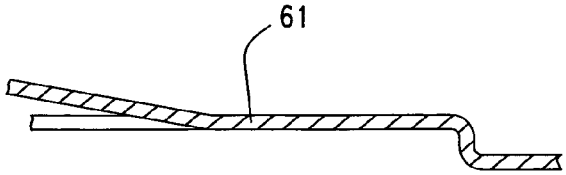
FIG. 4C is a cross-sectional view along the line C-C of FIG. 4B.
Figure 4D:
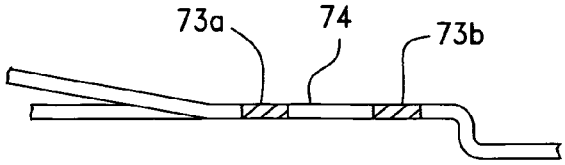
FIG. 4D is a cross-sectional view along the line D-D of FIG. 4B.
Figure 5A:
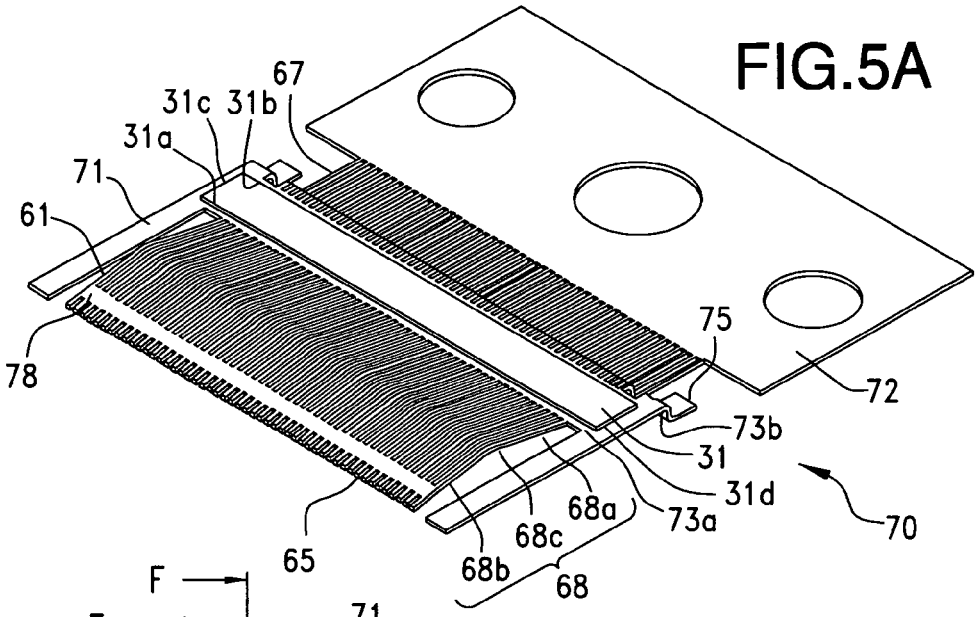
FIG. 5A is a second perspective view of elements to be used for the manufacture.
Figure 5B:
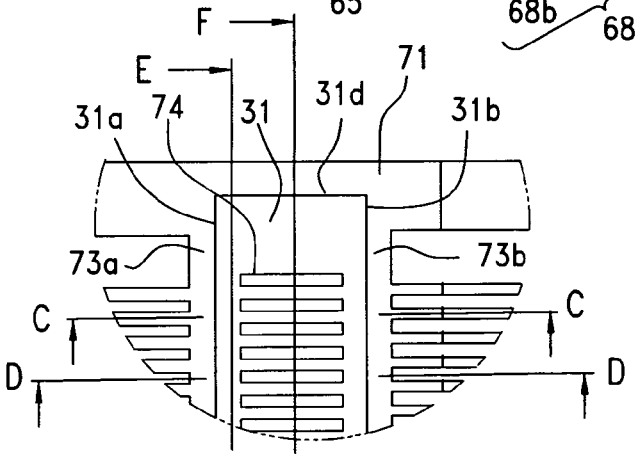
FIG. 5B is an enlarged plan view of the main part.
Figure 5F:
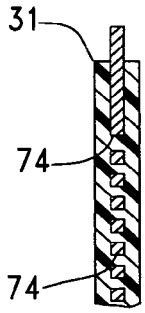
FIG. 5F is a cross-sectional view of the terminal holding member surrounding the frame member and showing slits therein.
Figure 5C:
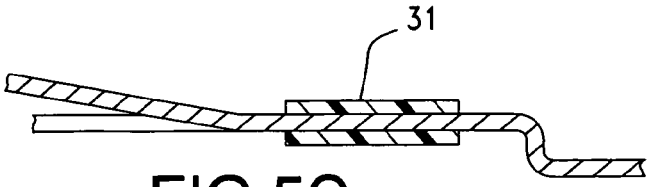
FIG. 5C is a cross-sectional view along the line C-C of FIG. 5B.
Figure 5E:
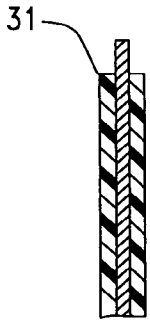
FIG. 5E is a cross-sectional view of the terminal holding member surrounding the frame member.
Figure 5D:
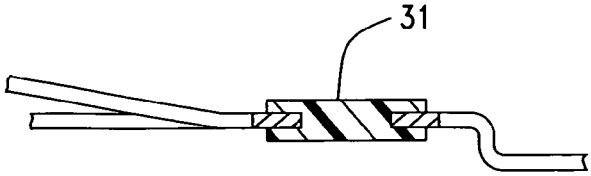
FIG. 5D is a cross-sectional view along the line D-D of FIG. 5B.
Figures 6A, 6B, 6C, 6D, 6E, 6F, 6G, 6H:
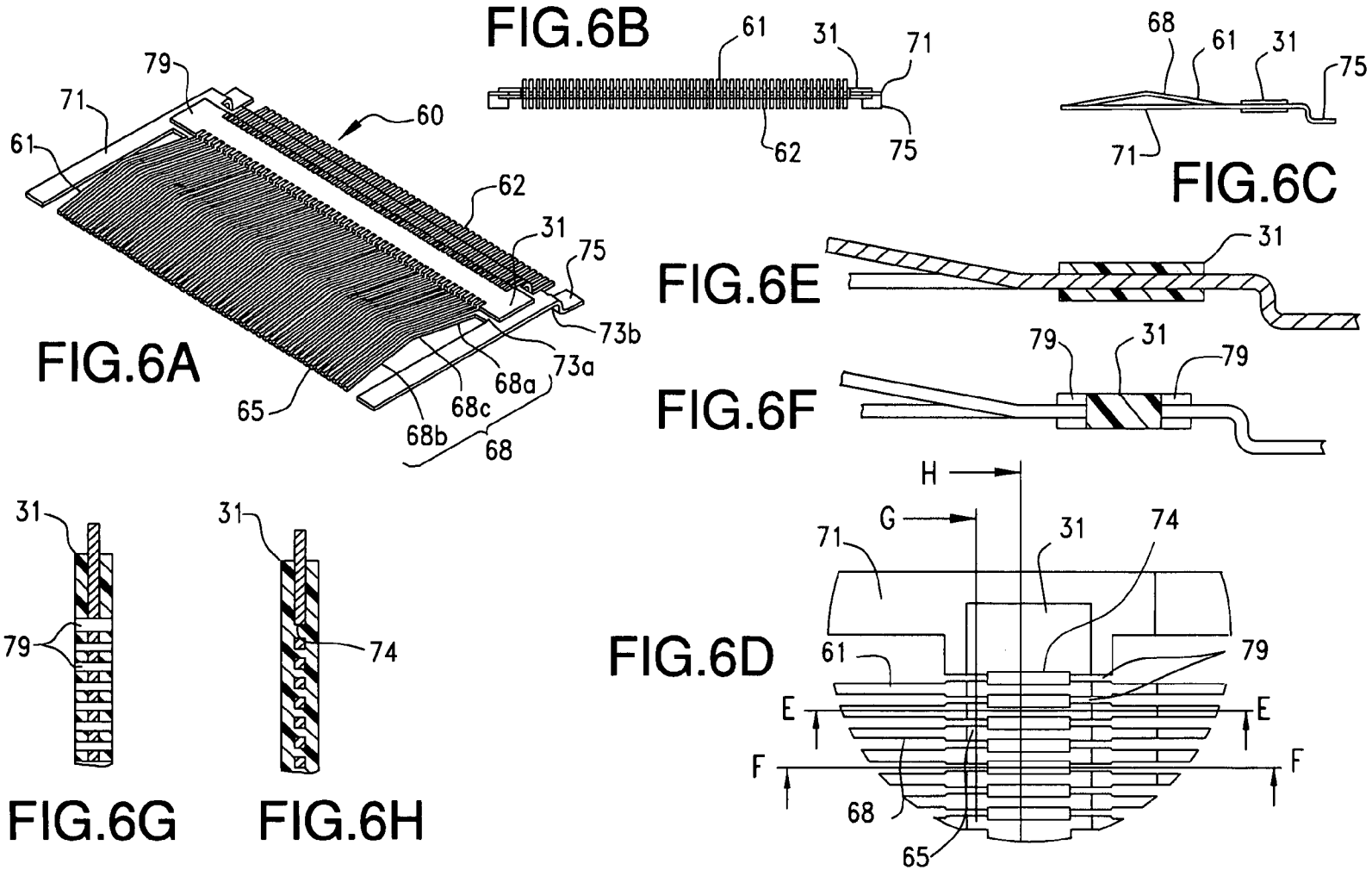
FIG. 6A is a perspective view.
FIG. 6B is a front view.
FIG. 6C is a side view.
FIG. 6D is an enlarged plan view of the main part.
FIG. 6E is a cross-sectional view along the line E-E of FIG. 6D.
FIG. 6F is a cross-sectional view along the line F-F of FIG. 6D.
FIG. 6G is a cross-sectional view along the line G-G of FIG. 6D.
FIG. 6H is a cross-sectional view along the line H-H of FIG. 6D.

With further reference to the slots, or slits 74 in FIG. 4D, same provide openings for the polymeric housing material to flow around as shown in FIGS. 5B-D, an integrated assembly of polymeric material and terminal body portions is formed during molding. As described in greater detail elsewhere herein, the terminal body portions then are singulated, or separated, from each other, as shown in FIG. 6D, with further details shown in FIGS. 6E-H, by way of stamping, shearing, laser etching or the like, which punches through or removes the plastic-metal-plastic portions of the network. This removing process only occurs in the area of the bridging portions and serves to remove portions thereof in line with the slots from the terminal carrier to separate the terminals from each other, which can be seen in FIG. 6E. The terminals 61 now are held by the plastic overmold, seen for example in FIGS. 6E and 6F.

Figure 7:
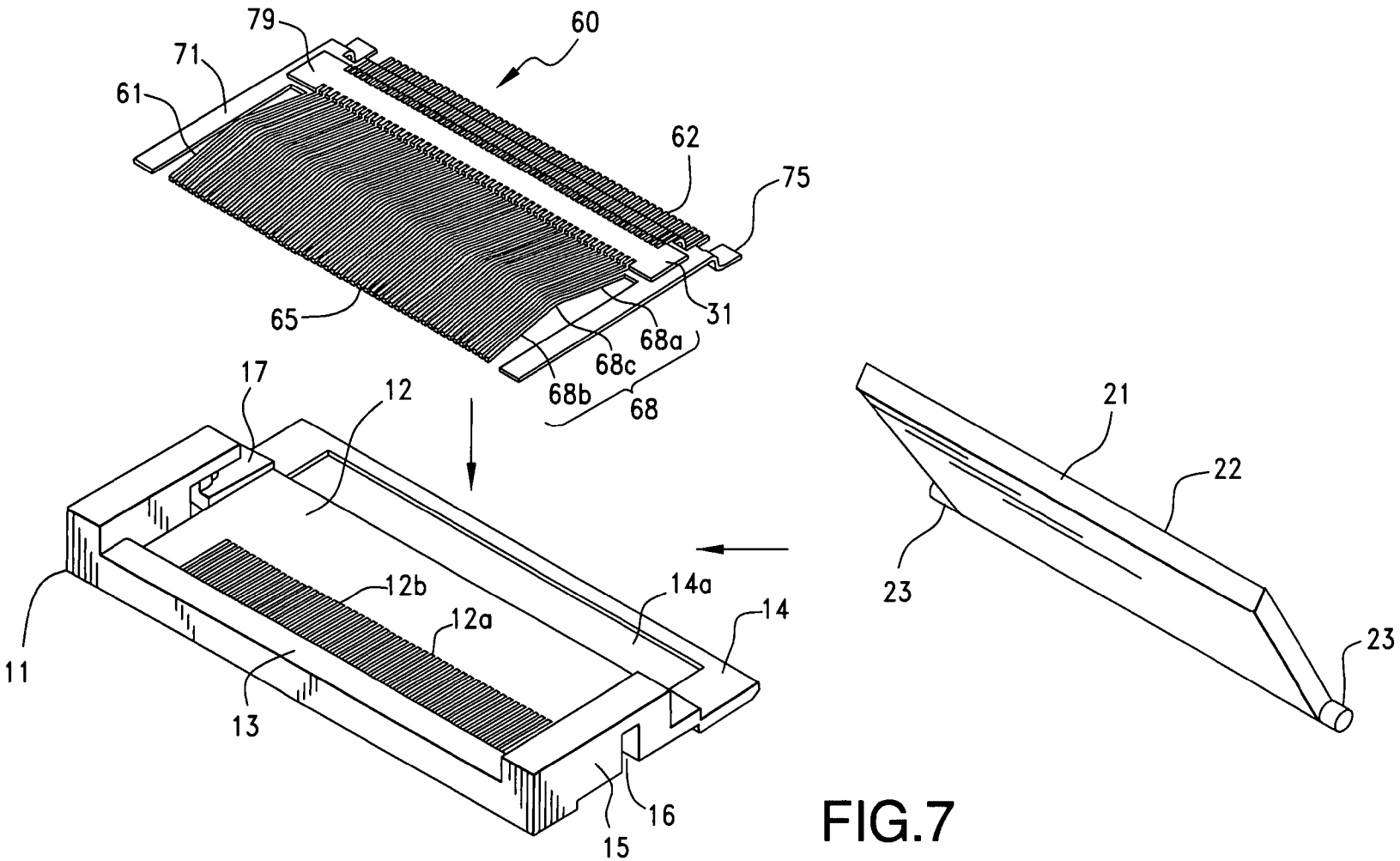
FIG. 7 is an exploded perspective view of the connector according to the first embodiment.

FIGS. 4-5 show manufacturing steps for making connectors, including connector 1, of the terminal assembly 60 according to the first embodiment. FIG. 6 is a diagram showing the terminal assembly 60 according to the first embodiment, and FIG. 7 is an exploded perspective view of this connector.

First, a conductive metal plate is subjected to die-cutting and bending workings by means of a machine tool such as a press unit to integrally form a preliminarily formed terminal product 70 as shown in FIG. 4. In this case, the die-cutting and bending may be carried out simultaneously or successively. In this regard, the preliminarily formed terminal product 70 may be formed by any type of working method such as laser working or etching.

The preliminarily formed terminal product 70 has a pair of frame members 71 extending in parallel with each other, and a plurality of terminals 61 extending in parallel with the frame members 71 and arranged at a predetermined pitch in parallel with one another. The frame members 71 and the terminals 61 typically are formed of the same metal plate.

Here, one end of each terminal 61 in the longitudinal direction is integrally connected to a plate-like carrier portion 72 via a carrier connecting portion 67. The carrier portion 72 is grasped by a conveying or transferring machine, a machine tool, a working tool, a jig, an operator's hand or the like so that every operation such as conveying or transferring and positioning of the preliminarily formed terminal product 70 is easily performed in a process of manufacturing the connector 1 or the terminal assembly 60. The carrier portion 72 is cut off at a final manufacturing stage. It is to be noted that in an example shown in the Figures, a single preliminarily formed terminal product 70 connected to the carrier portion 72 is shown, but the carrier portion 72 is usually a long strip-like plate material connected to a plurality of preliminarily formed terminal products 70 arranged in parallel with one another. In the example shown in the Figures, the carrier portion 72 is connected to only one end of the terminal 61 in the longitudinal direction, but the carrier portions 72 may be connected to opposite ends of the terminal 61 in the longitudinal direction as required. Furthermore, the frame member 71 may alternatively be connected to the carrier portion 72.

Moreover, one end of each of the terminals 61 in the longitudinal direction is provided with the stepped portion 62*a* and tail portion 62, respectively. The tail portion 62 is made integral with the carrier connecting portion 67 which connects the terminal 61 to the carrier portion 72, and one end of the frame member 71 is also similarly provided with the stepped portion 75*a* and the attaching portion 75.

Frame members 71 on the opposite sides are connected to each other via a sub-carrier portion 73 in the vicinity of one end of each member 71 in the longitudinal direction at a portion closer to the other end than to the stepped portion 75*a*. The sub-carrier portion 73 is integrally formed of the same metal plate as that of the frame member 71 and the terminal 61, extends in a direction orthogonal to the frame member 71, and its opposite ends are connected to the frame members 71. Sub-carrier portion 73 is provided with a plurality of slits 74 extending in parallel with the frame members 71 and arranged at a pitch equal to that of the terminals 61 in parallel with one another. The slits 74 are formed to be cut through the thickness or depth of the sub-carrier portion 73, and a strip-like portion between the adjacent slits 74 eventually becomes a part of the base end portion 66 of each terminal 61.

Opposite ends of each slit 74 in the longitudinal direction do not extend to the opposite ends of the sub-carrier portion 73 in the width direction thereof. Strip-like first and second terminal connecting portions 73*a* and 73*b* extending in the longitudinal direction (i.e., the direction orthogonal to the frame member 71) of the sub-carrier portion 73 are formed between the opposite ends of the slit 74 in the longitudinal direction and the opposite ends of the sub-carrier portion 73 in the width direction. The plurality of terminals 61 are connected to one another via the first terminal connecting portion 73*a* and the second terminal connecting portion 73*b* and are also connected to the frame members 71 on the opposite sides. Moreover, in each terminal 61, the arm portion 68, the tail portion 62 and the strip-like portion between the slits 74 are arranged to form the same straight line as viewed from above an upper surface of the terminal 61.

Second angled portions 68*b* of all the terminals 61 are connected to one another via a terminal sub-carrier portion 78. The terminal sub-carrier portion 78 is integrally formed of the same metal plate as that of the terminal 61, and extends in a direction orthogonal to the terminal 61, that is to say, in the direction terminals 61 are arranged. It is noted that the terminal sub-carrier portion 78 is not connected to the frame members 71.

In addition, a bending is applied to a connecting portion of the arm portion 68 to the base end portion 66 and to an intermediate portion of the arm portion 68 to form the first angled portion 68*a* angled with respect to the base end portion 66, the second angled portion 68*b* peak at a predetermined angle with respect to the first angled portion 68*a* and the peak portion 68*c*, which connects the first angled portion 68*a* to the second angled portion 68*b*.

Subsequently, a part of the preliminarily formed terminal product 70 is subjected to over-molding to form the terminal holding member 31 integrally formed of an insulating material such as a synthetic resin as shown in FIG. 5. Terminal holding member 31 is a member over-molded so as to enclose at least the center of the sub-carrier portion 73 from above and below, and has an elongated rectangular parallelepiped shape extending in the longitudinal direction of the sub-carrier portion 73. In this case, terminal holding member 31 fills all the slits 74 to thereby provide a connection between a part above the slits 74 and a part below the slits 74. Moreover, terminal holding member 31 is formed so that the opposite end portions thereof in the longitudinal direction coat at least a part of the frame members 71 on the opposite sides and at least a part of the base end portions 66 of all the direction terminals 61 are arranged.

Typically, terminal holding member 31 is provided so as to nip or grasp the preliminarily formed terminal product 70 in a thickness of the terminal holding member 31, and is eventually formed into a rectangular parallelepiped shape having a first side 31*a* and a third side 31*b* which are long sides and a second side 31*c* and a fourth side 31*d* which are short sides. As shown in FIG. 5, in relation to the dimension of both frame members 71 in the longitudinal direction, the terminal holding member 31 is formed so as to coat the entirety of slits 74, and is further formed to such an extent that the rectangular parallelepiped first side 31*a* is positioned on the first terminal connecting portion 73*a*, and the third side 31*b* parallel to the first side 31*a* is positioned on the second terminal connecting portion 73*b* to coat a part of the first and second terminal connecting portions 73*a* and 73*b*, respectively. A dimension of the frame member 71 in a direction orthogonal to the longitudinal direction is set to such a size that all the slits 74 are coated and that a part of the frame members 71 on the opposite sides is covered with the second side 31*c* and the fourth side 31*d* of the terminal holding member 31. Therefore, a flat-surface-like die parting surface surrounding a periphery of a cavity corresponding to the terminal holding member 31 in a die for forming the terminal holding member 31 is allowed to abut against the first terminal connecting portion 73*a*, the second terminal connecting portion 73*b* and the frame member 71 which are flat-plate-like members. Therefore, the above-mentioned terminal holding member 31 can be formed. When the first terminal connecting portion 73*a* and the second terminal connecting portion 73*b* are cut, respectively, so that the terminals 61 are separated from the frame members 71, the terminal holding member 31 is able to integrally hold the terminals 61 and the frame members 71 so that a positional relation between the respective terminals 61 and the frame members 71 does not change.

That is, when the terminal holding member 31 is formed by over-molding, the sub-carrier portion 73 is vertically nipped or grasped between a pair of dies each having the die parting surface provided with a cavity as a concave portion having a shape substantially corresponding to the half of the shape of the terminal holding member 31. Subsequently, a molten insulating material is allowed to enter a closed space formed by the cavities on the opposite sides. In this case, the flat-surface-like die parting surfaces of a pair of dies surrounding the peripheries of the cavities abut on both of upper and lower surfaces of the sub-carrier portion 73 to form the closed space. Therefore, if a gap is generated between the flat plate-like die parting surfaces surrounding the peripheries of the cavities and both of the upper and lower surfaces of the sub-carrier portion 73, the molten insulating material leaks from the gap, and the terminal holding member 31 cannot appropriately be formed. However, when the flat plate-like die parting surfaces surrounding the peripheries of the cavities are allowed to abut on the flat surfaces of the first terminal connecting portion 73*a*, the second terminal connecting portion 73*b* and the frame member 71, the flat-plate-like die parting surfaces surrounding the peripheries of the cavities are brought into close contact with the flat surfaces of the first terminal connecting portion 73*a*, the second terminal connecting portion 73*b* and the frame member 71. In this case, since no gap is generated, the molten insulating material does not leak.

Therefore, the terminal holding member 31 can appropriately be formed. The formation or development of "burrs" or "flash" from leaks of the formed insulating material can be prevented in that no insulating material is attached to a portion to be coated with the terminal holding member 31 or to a portion which should not be coated with the terminal holding member 31.

Moreover, the degree of resin encapsulation or enclosure of the terminal holding member 31, when coating the frame members 71, the first terminal connecting portion 73*a* and the second terminal connecting portion 73*b*, is appropriately determined in a state in which cut portions 79 are formed as described later and within a range in which the terminals 61 and the frame members 71 are integrally and fixedly held.

Next, as shown in FIG. 6, the above-mentioned slit-like cut portions 79 arranged in the longitudinal direction of the frame member 71 are formed in the first terminal connecting portion 73*a* and the second terminal connecting portion 73*b*. Further, an operation to cut a portion of the carrier connecting portion 67, such as in half, is performed so as to remove the carrier portion 72. Therefore, the terminal assembly 60 can be obtained. In this case, the cut portions 79 extend through the thickness of the first terminal connecting portion 73*a* and the second terminal connecting portion 73*b* and are formed so that the slits 74 extend in the longitudinal direction thereof to continue to provide the gaps between the adjacent terminals 61. Therefore, the slit-like gap extending over the whole longitudinal direction of the terminals 61 is formed between the terminals 61.

It is to be noted that as best shown in FIG. 6, the cut portions 79 are also formed integrally with the terminal holding member 31 which coats a part of the first terminal connecting portion 73*a* and a part of the second terminal connecting portion 73*b*. That is, the cut portions 79 are formed by cutting together the first terminal connecting portion 73*a*, the second terminal connecting portion 73*b* and opposite end portions of the terminal holding member 31 in the longitudinal direction of the terminals 61. The cut portions 79 are matched with the slit-like gaps between the terminals 61, and extend through the terminal holding member 31. Cut portions 79 may be formed by, for example, laser processing in which a member as a target for cutting is cut by the irradiation of the laser beam, but the cut portions 79 may be formed by any type of processing method.

Terminal sub-carrier portion 78 (FIG. 5) is also cut in the same manner as in the sub-carrier portion 73. In this case, the terminal sub-carrier portion 78 is cut so as to provide a mutual connection between gaps formed between the respective neighboring second angled portions 68*b*, which are connected to opposite sides of the terminal sub-carrier portion 78 and arranged adjacent to each other. Therefore, the terminal sub-carrier portion 78 which is left when cut forms a portion of the second angled portion 68*b*. As a result, the second angled portions 68*b* connected to each other via the terminal sub-carrier portion 78 are separated from each other.

Therefore, the second angled portions 68*b* are cut from the sub-carrier portion 73 via the slits 74 and the cut portions 79 and are separated from the adjacent terminals 61 and frame members 71. Terminal sub-carrier portion 78 is cut to separate the second angled portions 68*b* from each other. Each terminal 61 is formed into one elongated strip-like independent member continued from the tip end portion 65 to the tail portion 62. In this case, all terminals 61 are held by the terminal holding member 31 in a state in which a surrounding area of at least a part of each base end portion 66 is enclosed. The opposite end portions of the terminal holding member 31 in the longitudinal direction are connected to the frame members 71 on the opposite sides thereof. Therefore, the terminals 61 are held by the terminal holding member 31 while maintaining a state in which the terminals 61 arranged in the longitudinal direction of the frame member 71 are juxtaposed to the lateral direction of the frame member 71 and are arranged at a predetermined pitch in parallel with one another.

The terminal assembly 60 manufactured in the described manner has the frame members 71; the plurality of terminals 61 arranged at a predetermined pitch in parallel with one another; and the terminal holding member 31 connected to the frame members 71 to hold the terminals 61. Moreover, the frame members 71 are comprised of a pair of members extending in parallel with and arranged to be spaced apart from each other. The terminals 61 are arranged between the frame members 71, which are spaced apart toward the opposite sides so that the base end portions 66 are positioned close to one end of each of the frame members 71 in the longitudinal direction thereof and so that the tip end portions 65 are directed to the other ends of both frame members 71 in the longitudinal direction. The terminal holding member 31 is connected, at the opposite ends thereof in the longitudinal direction, to the frame members 71 and holds the base end portions 66 of the terminals 61.

As described above, the illustrated production is according to the following sequence. The terminal assembly 60 is manufactured by firstly forming the preliminarily formed terminal product 70 having a pair of frame members 71 and terminals 61 that extend in the longitudinal direction of the frame members 71, same being arranged in the lateral direction of the frame members 71 orthogonal to the longitudinal direction and mutually juxtaposed at the predetermined pitch, are integrally connected to the frame member 71 via the sub-carrier portion 73 having therein the slits 74, and these are connected to one another via the terminal sub-carrier portion 78. Subsequently, the preliminarily formed terminal product 70 is coated with the molding material by over-molding to form the terminal holding member 31 which coats at least a part of the sub-carrier portion 73. Finally, a part of the sub-carrier portion 73, that is to say cut portions 79 are formed to cut the first terminal connecting portion 73*a* and the second terminal connecting portion 73*b*. Terminal sub-carrier portion 78 is cut to separate the terminals 61 independently of one another. Therefore, the frame members 71 and all the terminals 61 can integrally be formed. Thus, the terminal assembly 60 can easily be produced in a reduced time. Even if the pitch of the terminals 61 is a micro value of, for example, 100 μm or less, the arrangement of the terminals 61 can accurately be maintained. Similarly, a positional relation between the terminals 61 and the frame members 71 can accurately be maintained.

Finally, as shown in FIG. 7, the terminal assembly 60 is secured to the housing 11 by any arbitrary but suitable securing means such as adhesive, and the rotary shaft portion 23 is inserted into the rotary shaft receiving opening 16 to attach the actuator 21 to the housing 11. Therefore, the connector 1 can be completed as shown in FIGS. 1-3.

Next, a description of a typical operation for connecting the flat-plate-like cable 101 to the connector 1 is provided hereinbelow. Reference is made particularly to FIG*s*. 8-9.

In this embodiment, the flat plate-like cable 101 has a substrate part 111 which is an insulating thin-plate member having an elongated strip-like shape, and a plurality of conductor wires (not shown) arranged on one surface of the substrate part 111. The conductor wires are linear foil-like materials made of a conductive metal such as copper, and are arranged at a predetermined pitch (e.g., 100 μm or less) in parallel with one another. Moreover, upper sides of the conductor wires are coated with an insulating layer 121. It is to be noted that in regions having a predetermined length from opposite ends of the flat plate-like cable 101, the insulating layer 121 is removed so that upper surfaces of the conductor wires are exposed to the exterior. An exposed portion of each conductor wire can function as a counterpart terminal which comes into contact with the tip end portion 65 of the terminal 61 to conduct electricity.

When the flat-plate-like cable 101 is connected to the connector 1, the actuator 21 is positioned to be brought into the opened position as shown in FIGS. 1-3. The positioning of the flat-plate-like cable 101 is adjusted so that the cable 101 extends in a vertical direction. A lower tip end portion of the flat-plate-like cable 101, that is a lower end portion thereof, is allowed to face an upwardly directed cable insertion opening of the cable accommodating concave portion 18 of the connector 1. In this case, the flat-plate-like cable 101 positioning is adjusted so that the conductor wires on an exposed side are directed toward the terminal fixing portion 14 and so that the conductor wires on a non-exposed side are directed toward the inner wall portion 13.

Subsequently, the flat plate-like cable 101 is moved toward the connector 1, namely lowered to insert the lower end portion of the flat-plate-like cable 101 into the cable accommodating concave portion 18 of the connector 1. In this case, a lower edge of the flat plate-like cable 101 is allowed to abut on an inner bottom surface of the cable accommodating concave portion 18 to position the flat plate-like cable 101 in an insertion and extraction direction.

Figure 8:
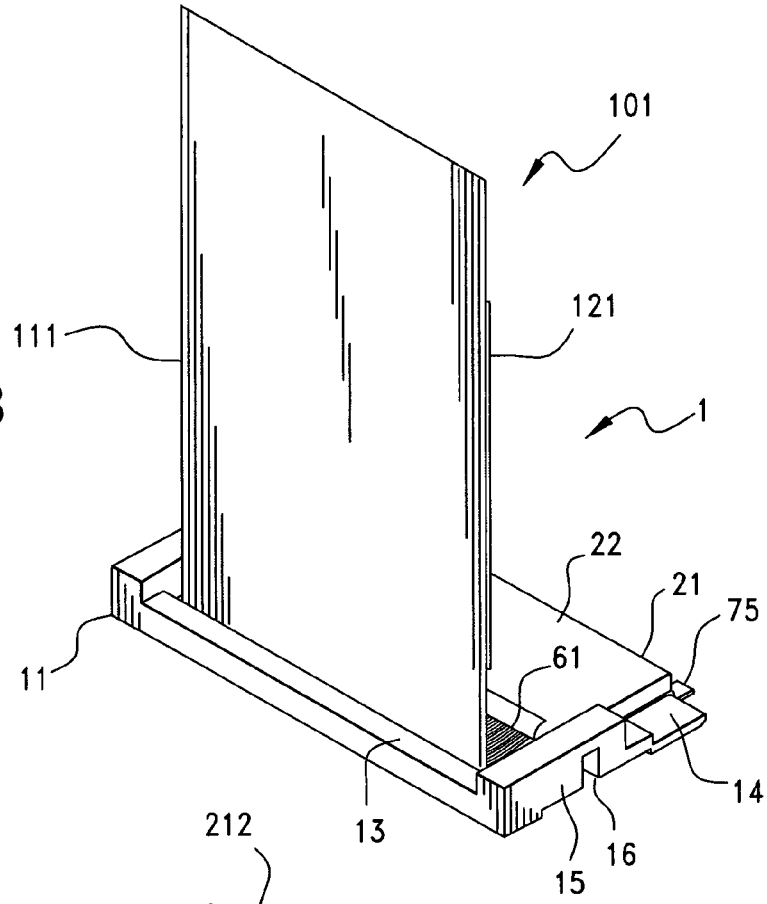
FIG. 8 is a perspective view of the connector connected to a flat-plate-like cable according to the first embodiment.
Figure 10:
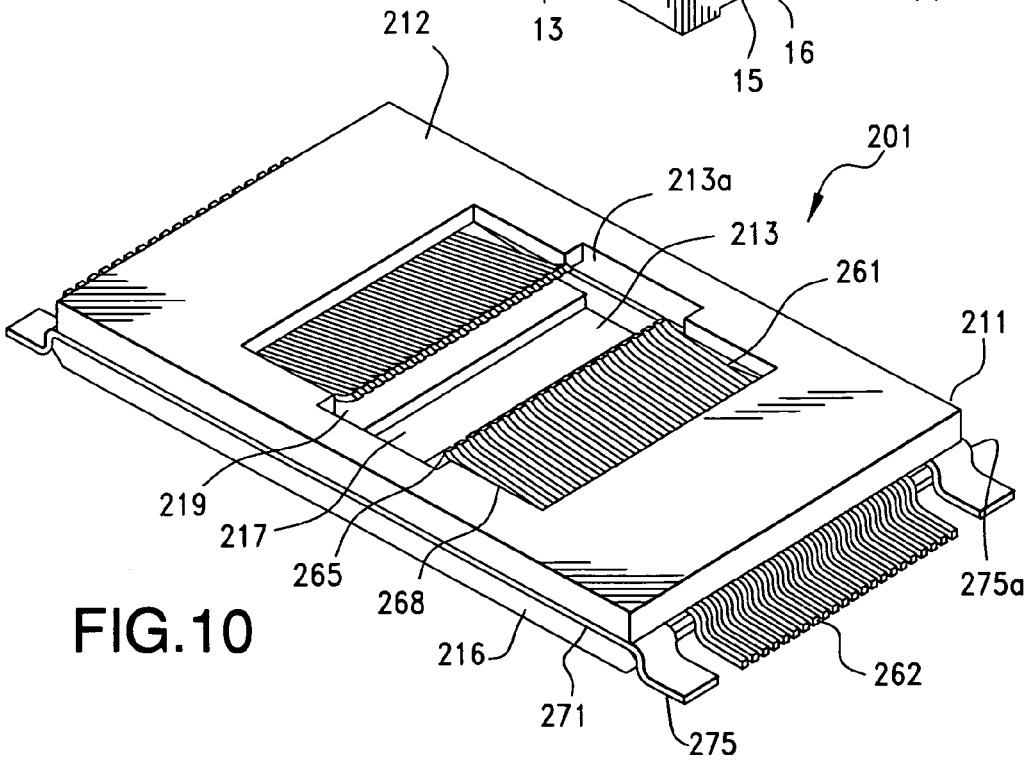
FIG. 10 is a perspective view of a connector according to a third embodiment.
Figure 9A:
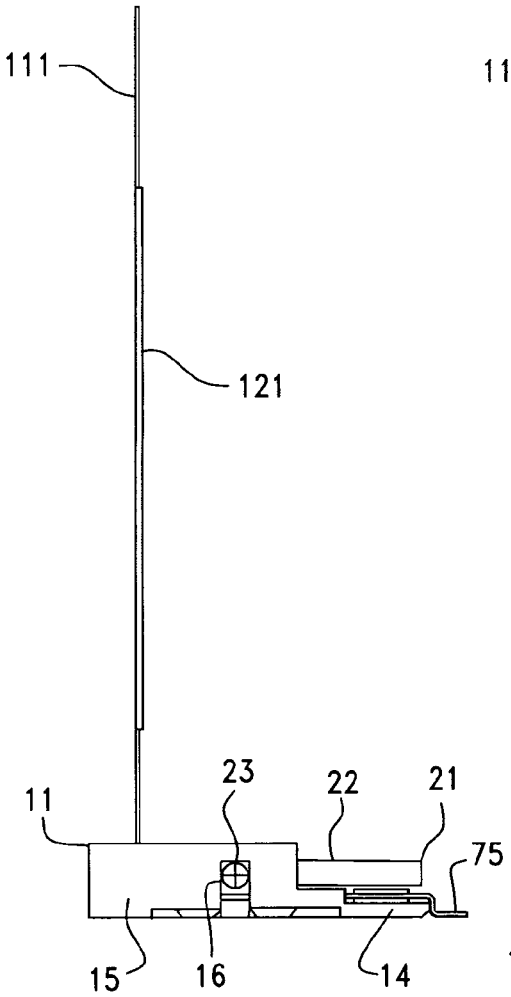
FIG. 9 is a complex view having a side view and a cross-sectional view of the connector connected to the flat-plate-like cable according to the first embodiment.
Figure 9B:
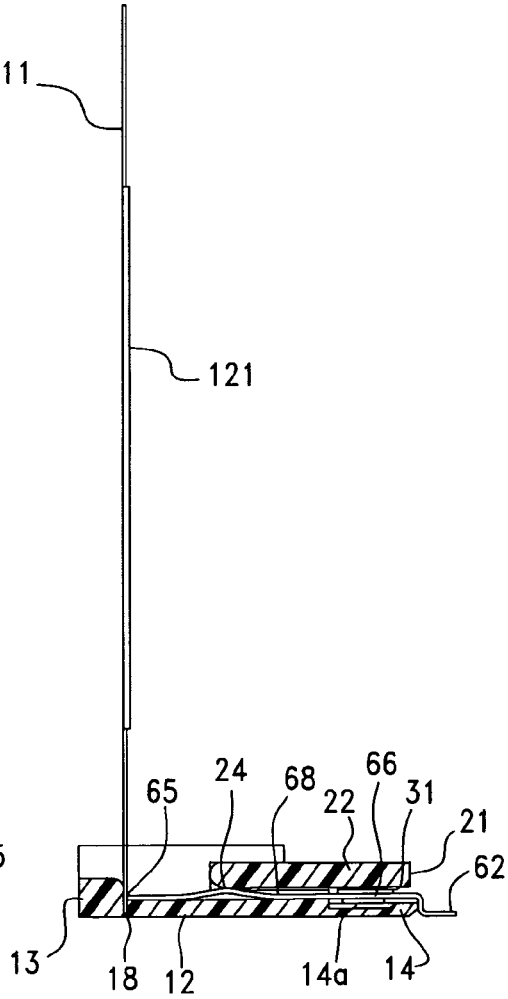

Subsequently, the actuator 21 is rotated about the central axis of the rotary shaft portions 23 to change the orientation thereof, and brought into the closed position as shown in FIGS. 8-9. When the actuator 21 changes from the opened position to the closed position, the operation surface 24 formed at one edge of the operating portion 22 of the actuator 21 functions as a cam, abuts against the peak portion 68*c* of the terminal 61, and depresses the peak portion 68*c*. The arm portion 68 is then elastically deformed, an angle of the peak portion 68*c* is enlarged, and a large part of the first angled portion 68*a* and the second angled portion 68*b* is pressed against the upper surface of the base portion 12. Therefore, the arm portion 68 extends in the longitudinal direction, and the tip end portion 65 which is the free end of the arm portion 68 moves toward the inner wall portion 13 to protrude toward the cable accommodating concave portion 18, and is pressed against the conductor wire of the flat-plate-like cable 101 inserted into the cable accommodating concave portion 18.

In this case, the peak portion 68*c* is depressed by the operation surface 24 of the actuator 21 to elastically deform the arm portion 68. Since the deformed arm portion 68 then exerts a spring force, the tip end portion 65 is urged by the spring force with respect to the conductor wire of the flat plate-like cable 101. It is noted that the spring force of the arm portion 68 applied from the tip end portion 65 to the conductor wire of the flat plate-like cable 101 is exhibited substantially in the direction corresponding to an extension direction of the arm portion 68.

Moreover, since the angle of the peak portion 68*c* is an obtuse angle and an angle of the first angled portion 68*a* and the second angled portion 68*b* with respect to the horizontal direction is much smaller than 45 degrees, a component of a force applied to the peak portion 68*c* in the vertical direction, extending along the longitudinal direction of the first angled portion 68*a* and the second angled portion 68*b*, is larger than the force applied in the vertical direction. Moreover, since the base portion 12 is fixed and the tip end portion 65 is movable in the horizontal direction, a total of the components of the spring force of the arm portion 68 extending along the longitudinal direction of the first angled portion 68*a* and the second angled portion 68*b* is applied to the tip end portion 65. Therefore, the tip end portion 65 exerts a large spring force substantially along the longitudinal direction of the arm portion 68.

As described above, the tip end portion 65 exerts a spring force larger than that exerted in the vertical direction. Therefore, even if the terminal 61 is an elongated strip-like member, a sufficiently large contact force can be exerted. For example, in order to arrange the terminals 61 at a pitch of 100 μm, a width of each terminal 61 cannot be chosen to be about 50 μm or more from a viewpoint of the working of the metal plate. However, in the present embodiment, in a case where a length of each of the first angled portion 68*a* and the second angled portion 68*b* is selected to be about 1 mm, a height of the peak portion 68*c* from the base portion 12 is set to be approximately 0.3 mm and a plate thickness is set to be approximately 0.05 mm, it is calculated that, when the operation surface 24 of the actuator 21 applies a downward force of 8 gf to the peak portion 68*c* of each terminal 61, each tip end portion 65 can exert a contact force of about 36 gf. Therefore, the terminals 61 can exert a sufficient spring force to keep in contact with the conductor wires of the flat plate-like cable 101. Moreover, the terminals 61 can securely and certainly hold the flat plate-like cable 101.

It is noted that a vertical dimension of the front end surface 13*a* of the inner wall portion 13 is larger than that of the inner end surface 12*c* of the base portion 12. Therefore, the flat plate-like cable 101 can be supported by the front end surface 13*a* from a backside thereof to receive the contact force exerted by the terminals 61.

When each of tip end portions 65 moves toward the inner wall portion 13, the tip end portions 65 and a portion of each of the second angled portions 68*b* close to the tip end portions 65 are seated in the terminal guide groove 12*b* between the guide protrusions 12*a*. Therefore, the position of the tip end portion 65 is not displaced in the direction of arrangement of the terminals 61. That is to say, since the positions of the tip end portions 65 do not deviate in the direction the terminals 61 are arranged, the tip end portions 65 securely come into contact with the corresponding conductor wires.

As described above, in the present embodiment, the preliminarily formed terminal product 70 is formed which has the terminals 61 arranged at the predetermined pitch in parallel with one another and integrally connected to one another via the sub-carrier portion 73. It is noted that the carrier portion 72 is connected to one end of each of the terminals 61, and the second angled portions 68*b* of all the terminals 61 are connected to each other via the terminal sub-carrier portion 78. The frame members 71 on the opposite sides are connected to the terminals 61 via the sub-carrier portion 73. Moreover, the frame member 71 is over-molded to form the terminal holding member 31 which coats at least a part of the sub-carrier portion 73. Next, a part of the sub-carrier portion 73 and a part of the terminal holding member 31 are both cut. Furthermore, the terminal sub-carrier portion 78 is cut to separate the terminals 61 independently of each other, and the terminal assembly 60 is obtained. Therefore, even if the terminals 61 are arranged at a small pitch, the terminal assembly 60 and the connector 1 can easily be manufactured in a short time. It is possible to obtain the miniaturized terminal assembly 60 and connector 1 in which the arrangement of the terminals 61 can accurately be maintained.

Each terminal 61 includes the base end portion 66 which is held by the terminal holding member 31; the elastically deformable arm portion 68 extending from the base end portion 66; the tip end portion 65 which comes into contact with the counterpart terminal at the free end of the arm portion 68; and the peak portion 68*c* formed at the arm portion 68 between the tip end portion 65 and the base end portion 66. When the angle of the peak portion 68*c* is enlarged, the tip end portion 65 is pressed against the conductor wire of the flat plate-like cable 101 by the force of the terminal 61 in the longitudinal direction. Therefore, it is possible to obtain the terminal assembly 60 and the connector 1 in which, even with a simple structure, a sufficient pressing force is exerted so that the terminals 61 constantly keep in contact with the conductor wires of the flat plate-like cable 101. Moreover, the flat plate-like cable 101 can be held securely. Furthermore, the pitch of the terminals 61 can be reduced, and height dimensions of the terminal assembly 60 and the connector 1 can be reduced. In addition, the terminal assembly 60 and the connector 1 can easily be manufactured, costs can be curtailed and miniaturization of the entire size can be achieved.

Each arm portion 68 includes the first angled portion 68*a* connected to the base end portion 66 and the second angled portion 68*b* connected to the first angled portion 68*a* via the peak portion 68*c*. The first angled portion 68*a* and the second angled portion 68*b* form the obtuse angle of the peak portion 68*c*. Therefore, even if a small force is applied to the peak portion 68*c* by the operation surface 24 of the actuator 21, the tip end portion 65 can substantially exert a large spring force along the longitudinal direction of the arm portion 68. The terminals 61 can keep in contact with the conductor wires of the flat plate-like cable 101, and the flat plate-like cable 101 can securely and certainly be held.

Figure 24:
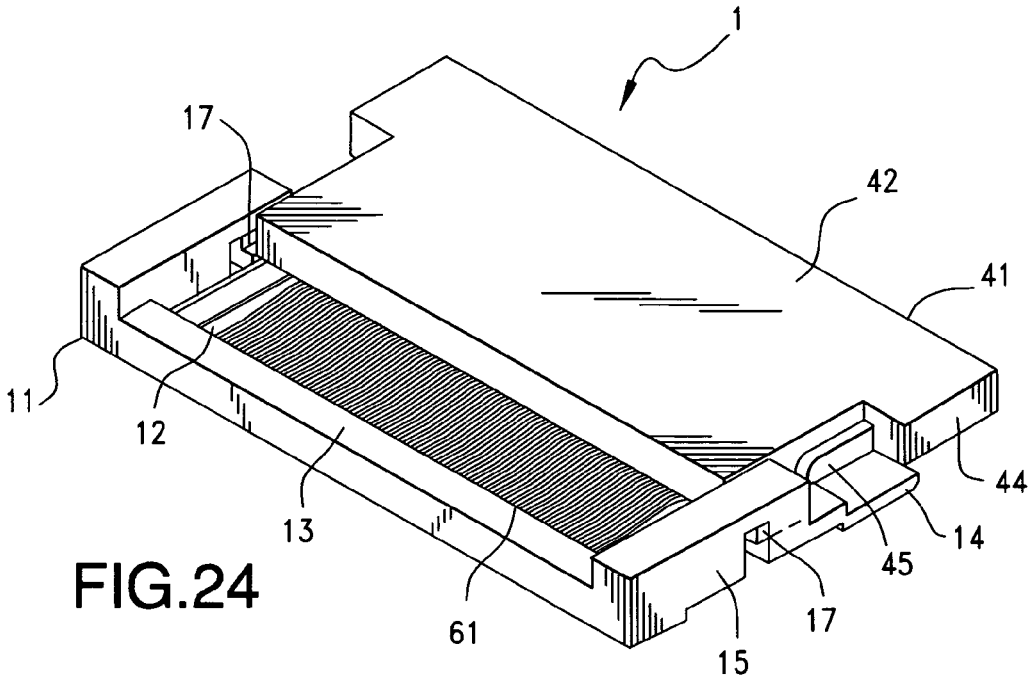
FIG. 24 is a perspective view of a connector according to a second embodiment.
Figure 25A:
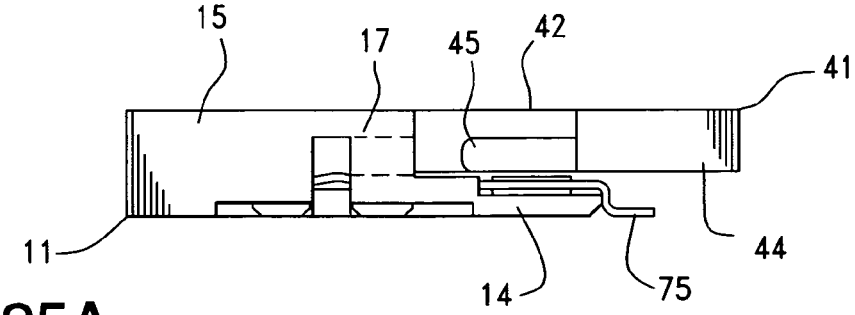
FIG. 25A is a side view and FIG. 25B is a cross-sectional view of the connector according to the second embodiment.
Figure 25B:
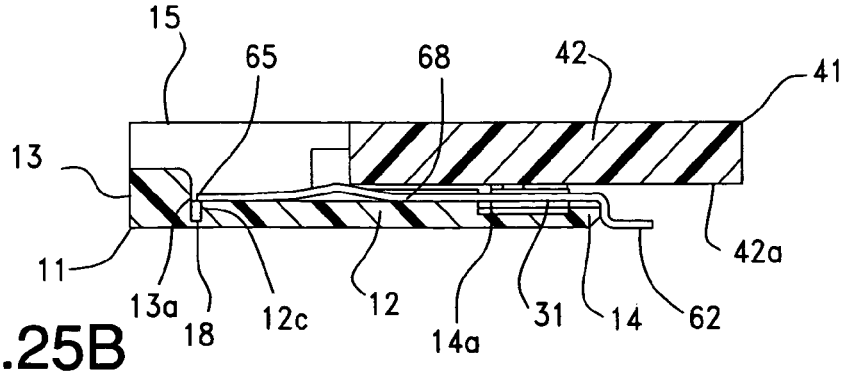

In a second embodiment, such as shown in FIGS. 24 and 25A-B, an actuator 41 is used as a cable fixing movable member. Actuator 41 is slidably mounted on a housing 11, and slides from an opened position to a closed position. Moreover, the actuator 41 has a substantially rectangular flat plate-like operating portion 42, an operation surface 42*a* of the operating portion 42 which confronts a base portion 12 and which comes in contact with a peak portion 68*c* of each terminal 61, protruding portions 44 which are arranged to protrude outwards from the opposite sides of the operating portion 42 and slide protrusions 45 which are provided to be engaged with slide grooves 17 disposed inwardly from side portions of the housing 11.

FIGS. 24 and 25A-B show a state in which the actuator 41 is situated at the opened position thereof. In this case, the operation surface 42*a* does not come in contact with an arm portion 68 of the terminal 61. When the actuator 41 is moved from an inserted opened position to the closed position, the operation surface 42*a* abuts on a first angled portion 68*a*, and abuts on the peak portion 68*c* in order to depress the peak portion 68*c*. In this case, the actuator 41 acts on the terminal 61 in a direction in which a tip end portion 65 is moved to an inner wall portion 13. Therefore, the tip end portion 65 can more smoothly be moved.

It is noted that various features of this embodiment are similar to that of the first embodiment, and description thereof is not repeated.

Figure 26:
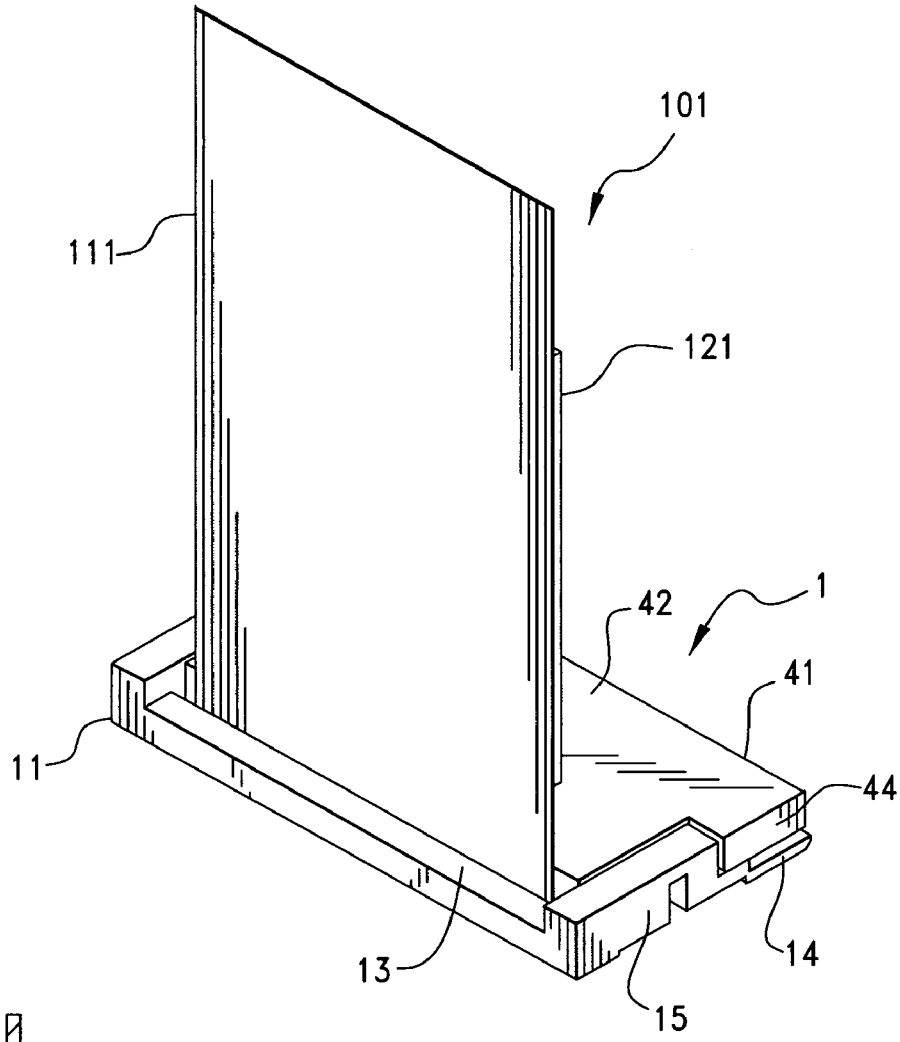
FIG. 26 is a perspective view of the connector connected to a flat-plate-like cable according to the second embodiment.
Figure 28:
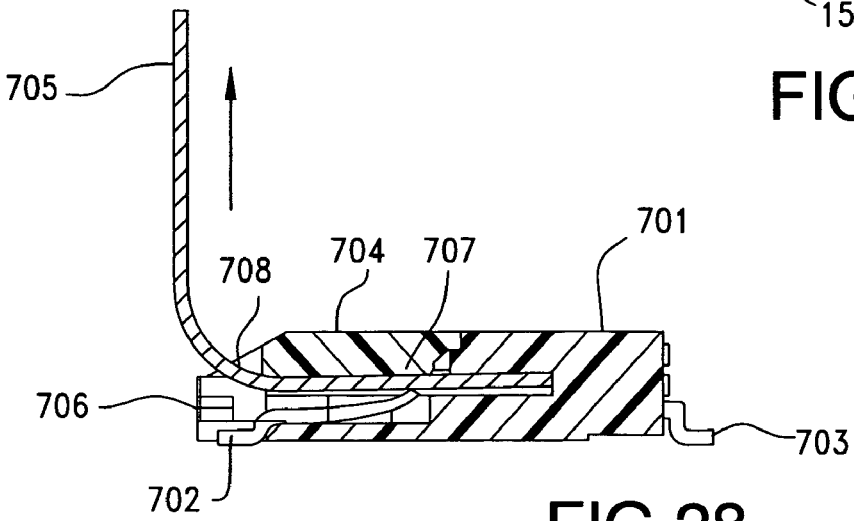
FIG.28 (Prior art)
FIG. 28 is a cross-sectional view showing a main part of a prior art cable connecting connector.
Figure 27A:
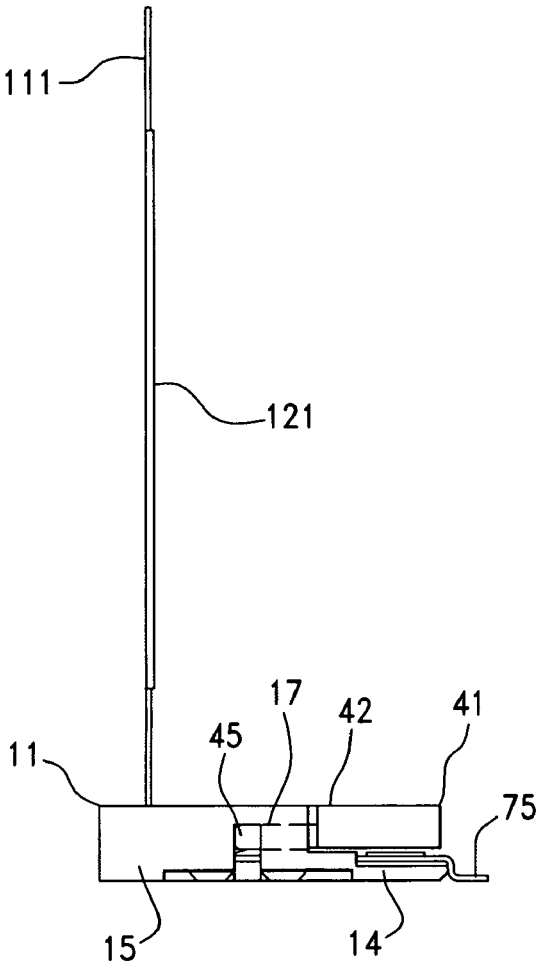
FIG. 27A is a side view and FIG. 27B is a cross-sectional view of the connector connected to the flat-plate-like cable according to the second embodiment.
Figure 27B:
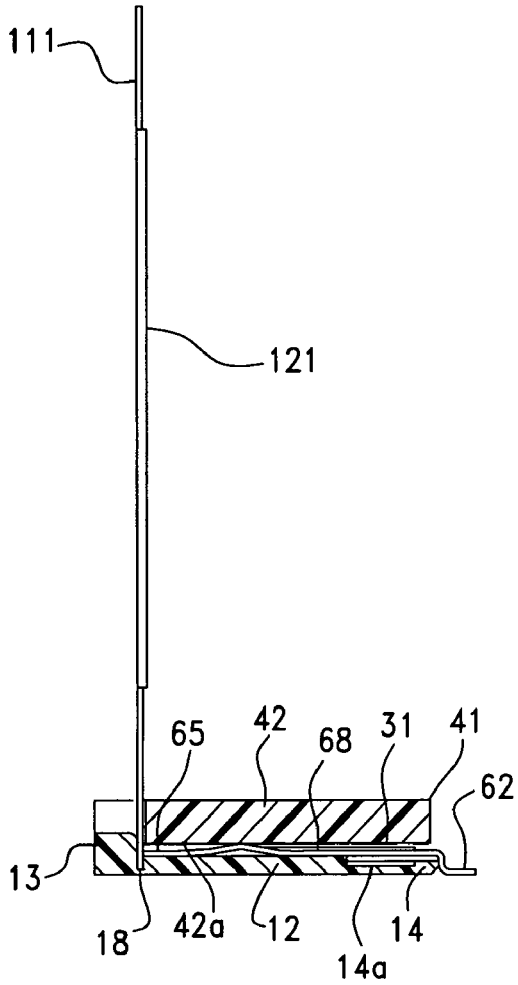
Figure 29:
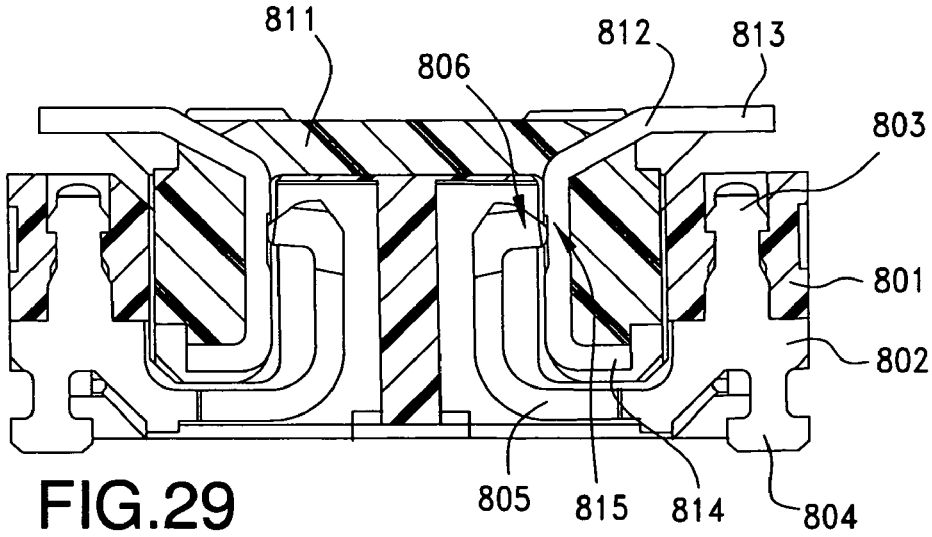
FIG.29 (Prior art)
FIG. 29 is a cross-sectional view of another prior art connector.
Figure 30:
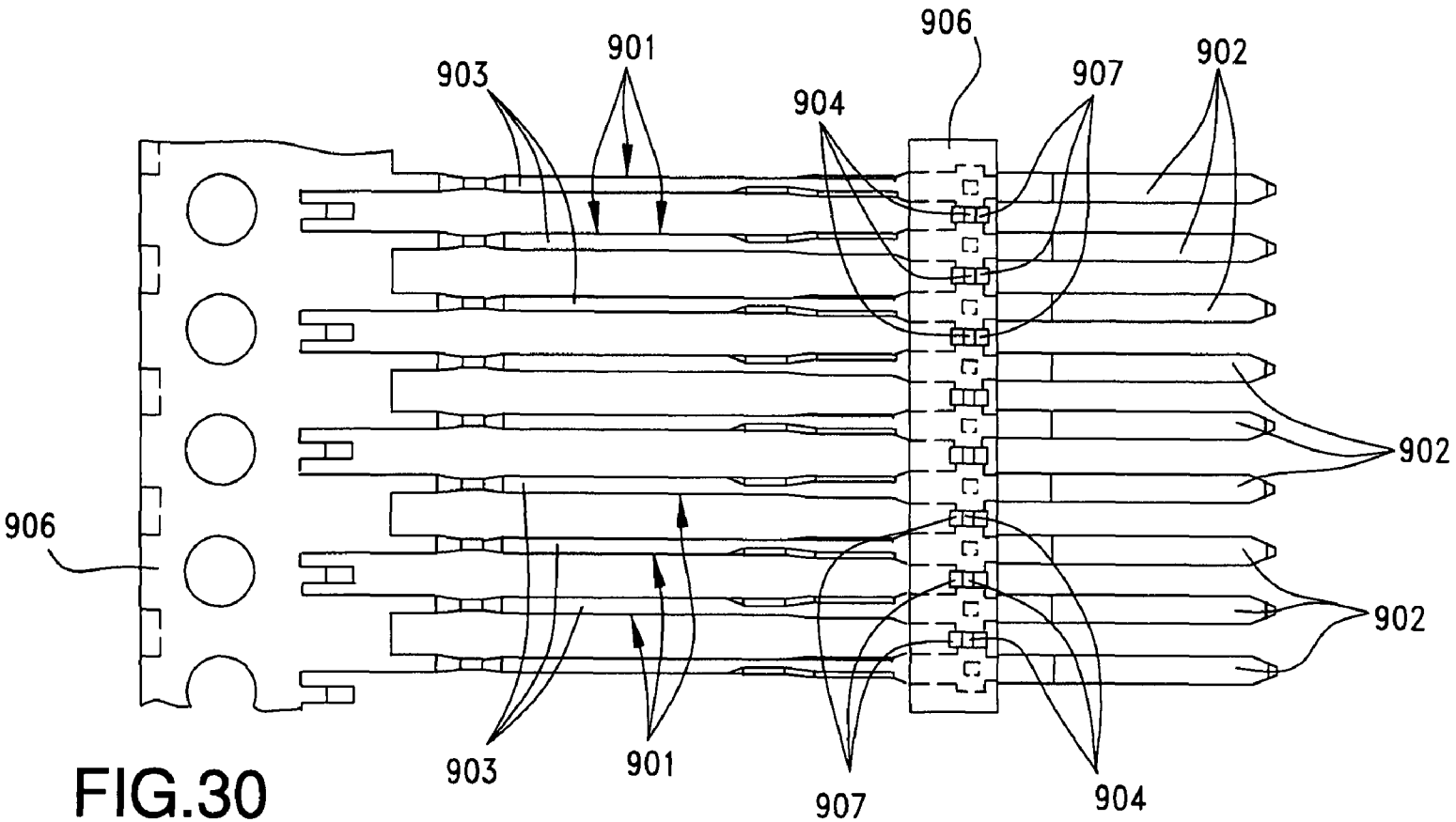
FIG.30 (Prior art)
FIG. 30 is a diagrammatic view showing a state of a prior art terminal assembly being manufactured.

Next, an illustration of connecting the flat plate-like cable 101 to a connector 1 according to the present embodiment is described with reference to FIGS. 26 and 27A-B.

In this second embodiment, since operations are performed, including when a lower end portion of the flat plate-like cable 101 is inserted into a cable accommodating concave portion 18 of the connector 1, are similar to those of the first embodiment, descriptions thereof are omitted.

Moreover, when the lower end portion of the flat plate-like cable 101 is inserted into the cable accommodating concave portion 18 of the connector 1, the actuator 41 is slid with respect to the housing 11, and brought into a closed position as shown in FIGS. 24 and 25A-B. When the actuator 41 is slid toward the inner wall portion 13, the slide protrusion 45 enters the slide groove 17 formed in an inner side surface of a side wall portion 15 of the housing 11 to engage with the slide groove 17. Therefore, the actuator 41 cannot move in a vertical direction with respect to the housing 11.

When the actuator 41 is slid toward the inner wall portion 13, the operation surface 42*a* abuts on the peak portion 68*c* to depress the peak portion 68*c*. The arm portion 68 is then elastically deformed, the angle of the peak portion 68*c* is enlarged, and a large part of the first angled portion 68*a* and the second angled portion 68*b* is pressed against an upper surface of the base portion 12. Therefore, the arm portion 68 extends in a longitudinal direction, and the tip end portion 65 (which is a free end of the arm portion 68) moves toward the inner wall portion 13 to enter the cable accommodating concave portion 18, and is pressed onto the conductor wire of the flat plate-like cable 101 that is inserted into the cable accommodating concave portion 18.

In this case, the peak portion 68*c* is depressed by the operation surface 42*a* of the actuator 41 to elastically deform the arm portion 68. Since the deformed arm portion 68 then exerts a spring force, the actuator 41 receives an upward spring force from the arm portion 68. However, since the slide protrusions 45 are engaged with the slide groove 17, the actuator 41 is not displaced upwards.

As described above, in the present embodiment, the actuator 41 slides to change from the opened position to the closed position. Therefore, even when the actuator 41 is present at the opened position, the height of the connector 1 can be reduced.

In the first and second embodiments, it has been described that the housing 11 is attached to the terminal assembly 60 to manufacture the connector 1 and the flat-plate-like cable 101 is connected to the connector 1. However, the terminal assembly 60 may be used without being attached to the housing 11. For example, the terminal assembly 60 may be mounted on the surface of the substrate. Moreover, a recessed portion may be formed in the surface of the circuit substrate, and the terminal assembly 60 may be mounted so as to store the terminal assembly 60 in the recessed portion. In such a case, the stepped portions 62*a*, 75*a* may be omitted, and the attaching portion 75 and the tail portion 62 may be positioned on the same plane as that of the frame member 71 and the base end portion 66 of the terminal 61. Further, the peak portion 68*c* may be depressed by a bar-like or plate-like member fixed to the substrate, instead of the described actuators 21 and 41.

Next, a third embodiment of the Present Disclosure will be described, with particular reference to FIGS. 10 and 11A-C. It is noted that portions and elements having the same structure as those of the first two embodiments are denoted with the same reference numeral to omit description thereof. Descriptions of the same operation and effect as those of the first two embodiments are omitted.

Reference numeral 201 denotes a connector of this embodiment. The connector has a terminal assembly 260 described later. The connector 201 may be a connector of any type, but here the description will be provided hereinbelow where the connector 201 is a surface mounted type connector to be mounted on the surface of a circuit substrate 291 described later. It is noted that the circuit substrate 291 is, for example, a printed circuit board, but may be of any type.

Moreover, connector 201 has a housing 211 as a connector main body integrally made and formed of an insulating material such as a synthetic resin, and a plurality of terminals 261 made and formed of a conductive metal. As shown in the drawings, housing 211 includes an upper half part 212 and a lower half part 216, and has a schematically rectangular thick-plate-like shape. Terminals 261 extend in a longitudinal direction of the housing 211 (a left-to-right direction in FIGS. 11B-C).

Figures 11A, 11B, 11C:
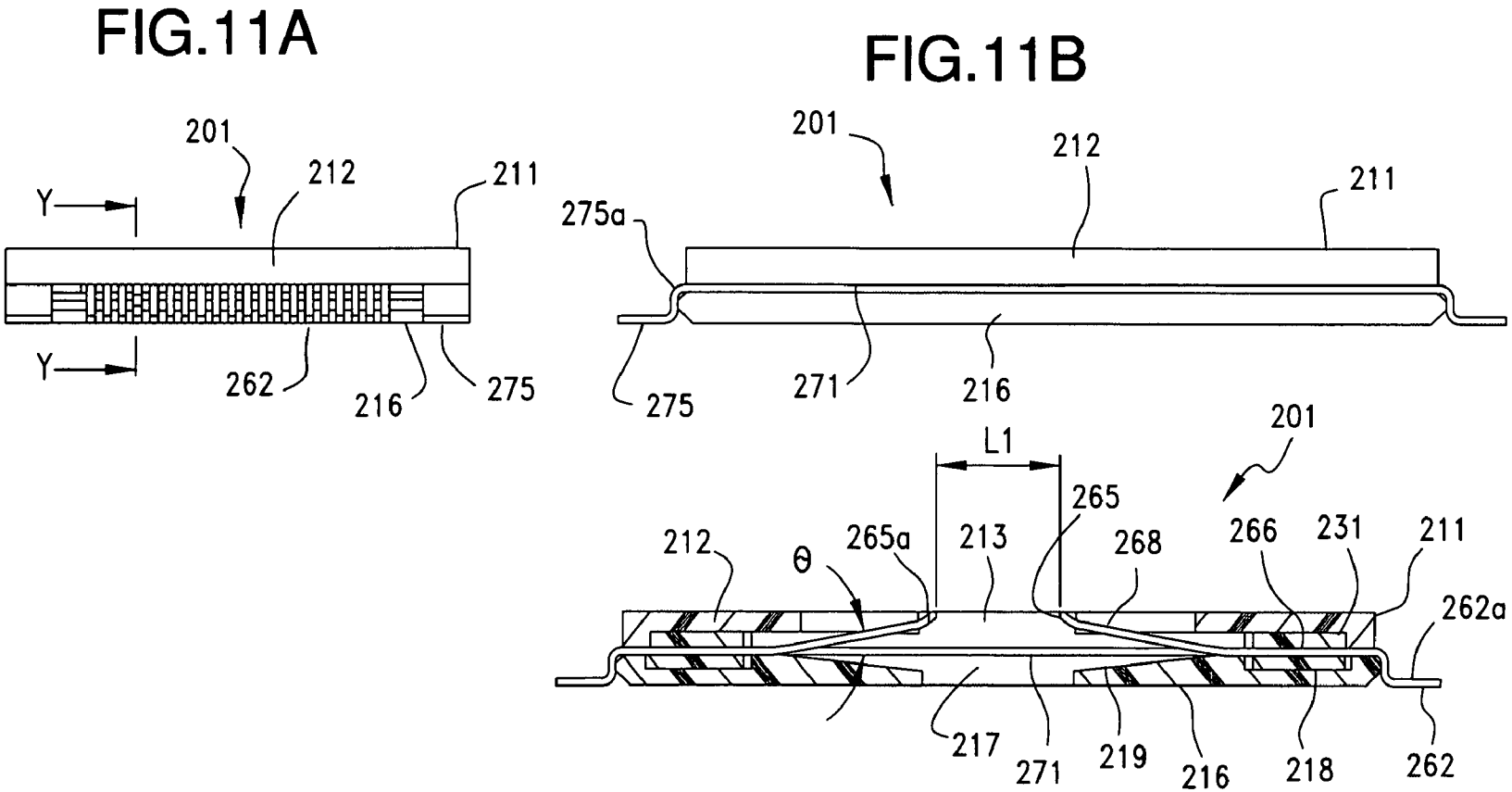
FIG. 11A is a front view.
FIG. 11B is a side view.
FIG. 11C is a cross-sectional view taken along the Y-Y arrow of FIG. 11A.
Figure 12A:
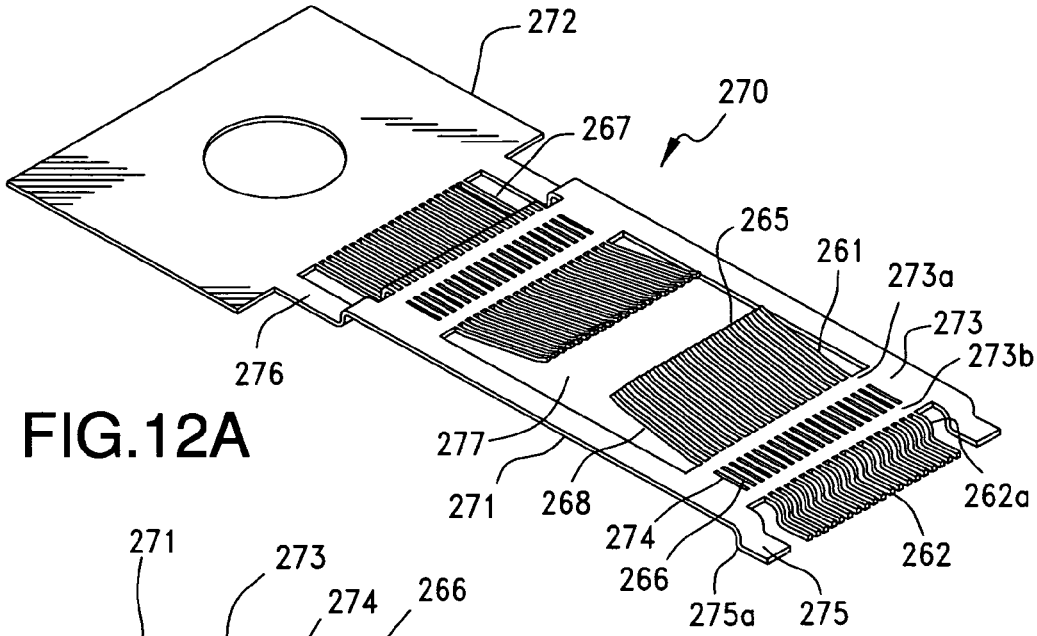
FIG. 12A is a first perspective view.
Figure 12B:
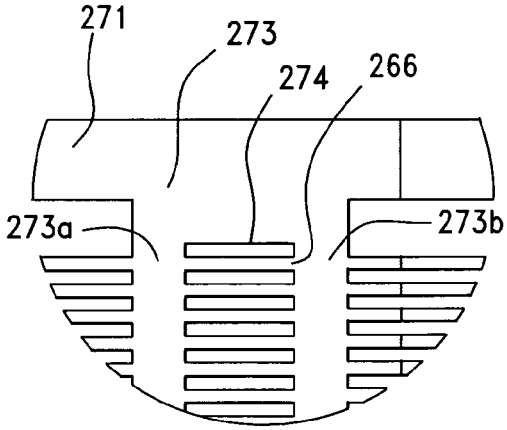
FIG. 12B is an enlarged view of a main part.

Here, the upper half part 212 includes a rectangular upper opening 213 formed in the center of the upper half part 212, extending through the upper half part 212 in a thickness direction (the vertical direction in FIG. 11) and disposed as an opening into which a counterpart connector 301 is fitted as described later. The lower half part 216 includes a rectangular lower opening 217 formed in the center of the lower half part 216, extending through the lower half part 216 in the thickness direction and disposed as an opening into which the counterpart connector 301 is fitted. The upper opening 213 is formed to be comparatively large so as to permit movement of arm portions 268 of the terminals 261 in the thickness direction. On the other hand, the lower opening 217 is formed to be comparatively small to such an extent that a tip end of the counterpart connector 301 can be stored. It is to be noted that a portion of the upper opening 213 corresponding to the lower opening 217 is provided with an expanded portion 213*a* so that the counterpart connector 301 can be stored. As shown in FIG. 11C, portions of the lower half part 216 adjacent to opposite sides of the lower opening 217 are provided with angled surfaces 219 angled so as to lower toward the lower opening 217 so that the movement of the arm portions 268 of the terminals 261 in the thickness direction are permitted.

It is noted that, in a case where the tip end of the counterpart connector 301 protrudes downwardly by a small amount, the lower opening 217 does not have to be necessarily an opening through which the connector 201 extends, and may be a recessed portion having a closed lower surface. Furthermore, when the tip end of the counterpart connector 301 protrudes downwardly by a smaller amount, the lower opening 217 may be omitted.

Illustrated terminals 261 are elongated strip-like members made of a metal plate having elasticity, extend in the longitudinal direction of the housing 211, are arranged in a lateral direction of the housing 211 and arranged at a predetermined pitch (e.g., 100 μm or less) in parallel with one another. Terminals 261 are attached to portions in the vicinity of opposite ends of the housing 211 in the longitudinal direction, respectively. Terminals 261 may be constructed of a metal plate made of phosphor bronze, a copper-beryllium alloy or the like, typically exhibiting a spring property. Pressing forces encountered as the terminals 261 are used tend to weaken the terminals 261 with respect to the counterpart terminals, particularly as the terminals 261 are thinned and/or miniaturized, which is addressed by the Present Disclosure. The necessary pressing force can be secured even if such a general material is used for forming the terminals 261 having the fine shape. A slit-like gap is formed between the terminals 261. The terminals 261 include two sets of terminals arranged so that the base end portions 266 are positioned on the opposite sides of the housing 211 in the longitudinal direction and so that the tip end portions 265 are directed to the center of the housing 211 in the longitudinal direction and positioned in the upper opening 213.

Specifically, as shown in FIG. 11C, the terminals 261 include the base end portions 266 which are arranged one after another in the longitudinal direction of the housing 211 so as to be in parallel with one another and which are held by a terminal holding member 231 integrally formed of an insulating material such as a synthetic resin; the arm portions 268 extending from the base end portions 266 to the center of the housing 211 in the longitudinal direction and angled upwards; the tip end portions 265 which are free ends of the arm portions 268; and tail portions 262 as soldered portions extending from a side of the base end portions 266 opposite to the arm portions 268 and protruding outwards from the opposite ends of the housing 211 in the longitudinal direction. It is noted that the tail portions 262 are connected to the surface of the circuit substrate 291 by soldering or the like. Therefore, the tail portions 262 are connected to the base end portions 266 via crank-like stepped portions 262*a* so that lower end surfaces of the tail portions 262 are disposed to be substantially even with a lower surface of the lower half part 216.

Terminal holding member 231 is a member formed by over-molding so as to enclose the base end portions 266 from above or below. The terminal holding member 231 has an elongated rectangular parallelepiped shape extending in a direction in which the terminals 261 are arranged one after another, namely in the lateral direction of the housing 211, and integrally holds all the base end portions 266 arranged one and after in the above-mentioned direction. A portion of the terminal holding member 231 below the base end portions 266 is received in an accommodating concave portion 218 formed in the lower half part 216. It is noted that the accommodating concave portion 218 is disposed outside the angled surface 219 in the longitudinal direction of the housing 211. Furthermore, the terminal holding member 231 is fixedly secured to the housing 211 in a state in which the terminal holding member 231 is vertically nipped or grasped between the upper half part 212 and the lower half part 216. Therefore, the base end portions 266 are held by the housing 211 via the terminal holding member 231.

Therefore, terminals 261 mounted on the housing 211 in the vicinity of the opposite ends of the housing are arranged so that the tail portions 262 extend outwards from the opposite ends of the housing 211 in the longitudinal direction, the arm portions 268 angle from opposite sides to the center of the housing 211 in the longitudinal direction and toward one side of the housing 211 in the longitudinal direction, namely angle upwards, and the tip end portions 265 are positioned in the upper opening 213 so as to face each other. It is preferable that the tip end portions 265 do not protrude upwards from the upper surface of the upper half part 212.

Frame members 271 made of a metal and extending in the longitudinal direction are attached to the opposite ends of the housing 211 in the lateral direction in a manner such that these members extend in a direction vertical to the longitudinal direction, i.e., in the lateral direction. Moreover, the frame members 271 are fixedly secured to the housing 211 in a state in which each of the frame members 271 is vertically nipped or grasped between the upper half part 212 and the lower half part 216. A part of each of the frame members is formed by over-molding and held by the terminal holding member 231. Opposite ends of each of the frame members 271 in the longitudinal direction are attachment portions 275 protruding outwards from the opposite ends of the housing 211 in the longitudinal direction. In the same manner as in the tail portions 262, the attachment portions 275 are connected to the surface of the circuit substrate 291 by soldering or the like via crank-like stepped portions 275*a* so that lower end surfaces of the attaching portions are disposed to be substantially even with a lower surface of the lower half part 216. Hence, the terminal holding member 231 can function as an auxiliary attachment fitting member for fixedly securing the connector 201 to the surface of the circuit substrate 291.

Next, a description of a manufacturing method of the connector 201 are provided hereinbelow, with specific reference to FIGS. 12A-B, 13A-B, 14A-D and 15, which show manufacturing steps of the terminal assembly according to the third embodiment of the Present Disclosure.

First, a conductive metal plate is subjected to die-cutting and bending workings by means of a machine tool such as a press unit to integrally form a preliminarily formed terminal product 270, as shown in FIG. 12. In this case, the die-cutting and the bending workings may simultaneously or successively be carried out. Further, it is to be noted that the preliminarily formed terminal product 270 may be formed by any type of working method such as laser processing or etching.

Preliminarily formed terminal product 270 has a pair of frame members 271 extending in parallel with each other, and a plurality of terminals 261 extending in parallel with the frame members 271 and arranged at a predetermined pitch in parallel with one another. Frame members 271 and terminals 261 typically are formed of the same metal plate.

In this illustrated arrangement, one end of each of the frame members 271 in the longitudinal direction is integrally connected to a plate-like carrier portion 272 via a first carrier connecting portion 276. The carrier portion 272 is a member to be grasped by a conveying or transferring machine, a machine tool, a working tool, a jig, an operator's hand or the like so that every operation such as conveying or transferring and positioning of the preliminarily formed terminal product 270 is easily performed in a process of manufacturing the connector 201 or the terminal assembly 260. The carrier portion 272 is cut and removed in a final manufacturing stage. It is noted that in an example shown, the single preliminarily formed terminal product 270 connected to the carrier portion 272 is shown, but the carrier portion 272 is usually a long strip-like plate material connected to a plurality of preliminarily formed terminal products 270 arranged in parallel with one another. In the example shown, the carrier portion 272 is connected to only one end of each of the frame members 271 in the longitudinal direction, but the carrier portions 272 may be connected to the opposite ends of the frame member 271 in the longitudinal direction as required.

The opposite ends of each of the frame members 271 in the longitudinal direction are provided with stepped portions 275*a* and attachment portions 275, respectively. It is noted that the attachment portion 275 on a carrier portion 272 side is made integral with the first carrier connecting portion 276. Furthermore, an end of the base end portion 266 of each terminal 261 is also similarly provided with a stepped portion 262*a* and a tail portion 262. It is noted that the tail portion 262 on a carrier portion 272 side is made integral with a second carrier connecting portion 267 which connects the terminals 261 to the carrier portion 272.

Furthermore, the frame members 271 on the opposite sides are connected to each other via sub-carrier portions 273 in the vicinity of opposite ends of each of the members 271 in the longitudinal direction at portions closer to the center than to the stepped portions 275*a*. Sub-carrier portions 273 are integrally formed of the same metal plate as that of the frame members 271 and the terminals 261 and extend in a direction orthogonal to the frame members 271, and the opposite ends thereof are connected to the frame member 271. Moreover, each sub-carrier portion 273 is provided with a plurality of slits 274 extending parallel with the frame member 271 and arranged at a pitch equal to that of the terminals 261 parallel with one another. Each slit 274 is formed so as to cut through the sub-carrier portion 273 in the thickness direction, and a strip-like portion between the adjacent slits 274 becomes a part of the base end portion 266 of each terminal 261.

Opposite ends of each slit 274 in the longitudinal direction do not extend to the opposite ends of the sub-carrier portion 273 in the width direction thereof. Strip-like first and second terminal connecting portions 273*a* and 273*b* extending in the longitudinal direction (i.e., the direction orthogonal to the frame member 271) of the sub-carrier portion 273 are formed between the opposite ends of the slit 274 in the longitudinal direction and the opposite ends of the sub-carrier portion 273 in the width direction. The plurality of terminals 261 are connected to one another via the first terminal connecting portion 273*a* and the second terminal connecting portion 273*b*, and also connected to the frame members 271 on the opposite sides thereof.

Furthermore, a substantially rectangular arm portion receiving opening 277 is formed between the sub-carrier portions 273 on the opposite sides of the frame member 271 in the longitudinal direction, and the arm portions 268 extending from the base end portions 266 on the opposite sides to the centers of the frame members 271 in the longitudinal direction are arranged in the arm portion receiving opening 277. It is noted that each arm portion 268 is provided with a bend portion 268*a* on a base end portion 266 side and peak at an angle θ, and the arm portion 268 angles upwards, same being between about five and about 20 degrees (θ typically is about ten degrees in the present embodiment). The arm portions 268 are arranged so as to form the same straight lines as those of strip-like portions between the corresponding tail portions 262 and between the slits 274 as viewed from above an upper surface of the member.

An interval "L1" is provided between tip ends of the tip end portions 265 of the terminals 261 facing each other, namely between contacts 265*a* which come into contact with counterpart contact portions 364. Each interval "L1" is made slightly larger than an interval "E1" between exposed contact portions formed by the counterpart contact portions 364 of later-described counterpart connector 201. Thus, the contacts 265*a* can accept counterpart terminals 361 of the counterpart connector 301 to eventually allow the former contacts to be in contact with the latter terminals.

With this arrangement, the interval "L1" changes in a downward movement region of the tip end portions 265 from the uppermost position thereof, and the interval "L1" becomes smaller than the interval "E1" with the movement of the tip end portions 265. Moreover, the shape of each terminal 261 including various variables such as the bend or terminal angle "θ", the interval "L1", a length of the arm portion 268, a length of the tip end portion 265 and the like is appropriately determined in accordance with necessary requirements of a contact force between the terminals 261 and the counterpart terminals 361, a tactile feeling (a feeling of click) at a time when the counterpart connector 301 is brought into being fitted with the connector 201, a locked state and the like.

Next, a part of the preliminarily formed terminal product 270 is subjected to over-molding to form the terminal holding member 231 integrally formed of an insulating material such as a synthetic resin as shown in FIG. 13. Terminal holding member 231 is a member over-molded so as to enclose the center of the sub-carrier portion 273 from above and below, and has an elongated rectangular parallelepiped shape extending in the longitudinal direction of the sub-carrier portion 273. In this case, the terminal holding member 231 fills all the slits 274 to thereby provide a connection between a part above the slits 274 and a part below the slits 274. Terminal holding member 231 is formed so that opposite end portions thereof in the longitudinal direction coat at least a part of the frame members 271 on the opposite sides and at least a part of the base end portions 266 of all the terminals 261 arranged in the arrangement direction.

The terminal holding member 231 is preferably provided so as to nip or grasp the preliminarily formed terminal product 270 in a the direction of the thickness of the terminal holding member 231, and is eventually formed in a rectangular parallelepiped shape having a first side 231*a* and a third side 231*b* which are long sides and a second side 231*c* and a fourth side 231*d* which are short sides as viewed from above an upper surface of the member. As shown in FIG. 13, in relation to the dimension of the frame members 271 in the longitudinal direction, the terminal holding member 231 is formed so as to coat the entirety of slits 274, and is further formed to such an extent that the rectangular parallelepiped first side 231*a* is positioned on the first terminal connecting portion 273*a*, and the third side 231*b* parallel to the first side 231*a* is positioned on the second terminal connecting portion 273*b* to coat a part of the first and second terminal connecting portions 273*a* and 273*b*, respectively. The frame member 271 has a dimension in a direction orthogonal to the longitudinal direction so as to coat all the slits 274 and a part of the frame members 271 on opposite sides. The second side 231*c* and the fourth side 231*d* of the terminal holding member 231 are formed on the surfaces of the frame members 271 so as to coat a part of the surfaces. Therefore, when flat-plate-like die parting surfaces surrounding a periphery of a cavity corresponding to the terminal holding member 231 in a die for molding the terminal holding member 231 are allowed to abut against the first terminal connecting portion 273*a*, the second terminal connecting portion 273*b* and the frame member 271 which are flat plate-like members, the above-mentioned terminal holding member 231 can be formed.

In substantially the same manner as terminal holding member 31 is molded in the first embodiment, when the terminal holding member 231 is formed by over-molding, the sub-carrier portion 273 is vertically nipped or grasped between a pair of dies each having the die parting surface provided with a cavity as a concave portion having a shape substantially corresponding to half of the shape of the terminal holding member 231. Subsequently, a molten insulating material is allowed to enter a closed space formed by the cavities on the opposite sides. In this case, the flat-surface-like die parting surfaces of a pair of molds surrounding peripheries of the cavities abut on both of upper and lower surfaces of the sub-carrier portion 273 to form the closed space. Therefore, if a gap is generated between the flat-plate-like die parting surfaces surrounding peripheries of the cavities and both of the upper and lower surfaces of the sub-carrier portion 273, the molten insulating material leaks from the gap, and the terminal holding member 231 cannot appropriately be formed. However, when the flat plate-like die parting surfaces surrounding the peripheries of the cavities are allowed to abut on the flat surfaces of the first terminal connecting portion 273*a*, the second terminal connecting portion 273*b* and the frame member 271, the flat plate-like die parting surfaces surrounding the peripheries of the cavities are brought into close contact with the flat surfaces of the first terminal connecting portion 273*a*, the second terminal connecting portion 273*b* and the frame member 271. Since no gap is generated, the molten insulating material does not leak.

Therefore, the terminal holding member 231 can appropriately be formed without "burrs" or "flash" from insulating material that otherwise may leak during manufacture, so that no insulating material is attached to a portion to be coated with the terminal holding member 231 or so that no insulating material is attached to a portion which should not be coated with the terminal holding member 231.

Moreover, as described above, the degree of enclosure by the resin of the terminal holding member 231, which is employed for coating the frame members 271, the first terminal connecting portion 273*a* and the second terminal connecting portion 273*b*, is appropriately determined in a state in which cut portions 279 are formed as described later and within a range in which the terminals 261 and the frame members 271 are integrally and fixedly held.

Next, as shown in FIG. 14, the slit-like cut portions 279 arranged in the longitudinal direction of the frame member 271 are formed in the first terminal connecting portion 273*a* and the second terminal connecting portion 273*b*. Further, an operation to cut a portion of the first carrier connecting portion 276 and the second carrier connecting portion 267 is performed so as to remove carrier portion 272. Therefore, the terminal assembly 260 can be obtained. In this case, cut portions 279 extend through the first terminal connecting portion 273*a* and the second terminal connecting portion 273*b* in the thickness direction, and are formed so as to connect opposite ends of the slits 274 to opposite ends of the sub-carrier portion 273 in the width direction. Therefore, a slit-like gap extending the whole longitudinal direction of the terminals 261 is formed between the terminals 261.

As shown in FIG. 14, cut portions 279 are also formed integrally with the terminal holding member 231 which coats a part of the first terminal connecting portion 273*a* and a part of the second terminal connecting portion 273*b*. That is, the cut portions 279 are formed by cutting the first terminal connecting portion 273*a*, the second terminal connecting portion 273*b* and the terminal holding member 231 together. The cut portions 279 are matched with the slit-like gaps between the terminals 261, and extend through the terminal holding member 231. It is noted that cut portions 279 may be formed by, for example, laser processing in which a member as a target for cutting is cut by the irradiation of the laser beam, but the cut portions may be formed by any type of processing method.

Therefore, the terminals 261 are cut from the sub-carrier portion 273 via the slits 274 and the cut portions 279, and separated from the adjacent terminals 261 and frame members 271. Each terminal 261 is formed into one elongated strip-like independent member continued from the tip end portion 265 to the tail portion 262. In this case, all the terminals 261 are held by the terminal holding member 231 in a state in which a surrounding area of at least a part of each base end portion 266 is enclosed. The opposite end portions of the terminal holding member 231 in the longitudinal direction are connected to the frame members 271 on the opposite sides thereof. Therefore, the terminals 261 are held by the terminal holding member 231 while maintaining a state in which the terminals arranged in the longitudinal direction of the frame member 271, are juxtaposed to the lateral direction of the frame member 271 and are arranged at the predetermined pitch in parallel with one another.

The terminal assembly 260 manufactured in the described manner has frame members 271; a plurality of terminals 261 arranged at the predetermined pitch in parallel with one another; and a terminal holding member 231 connected to the frame members 271 to hold the terminals 261. Moreover, the frame member 271 includes a pair of members extending in parallel with each other and arranged to be spaced apart from each other. The terminals 261 include two sets of terminals arranged between the frame members 271, which are spaced apart toward the opposite sides so that the base end portions 266 are positioned on the opposite sides of each of the frame members 271 in the longitudinal direction thereof and so that the tip end portions 265 are directed to the centers of the frame members 271 in the longitudinal direction thereof. The terminal holding member 231 includes a pair of members extending in parallel with each other, and the members are connected to the frame members 271 at opposite ends in the longitudinal direction, and the terminal holding member 231 holds the base end portions 266 of one set of terminals 261.

Such a terminal assembly 260 is manufactured by firstly forming the preliminarily formed terminal product 270 having a pair of frame members 271 and the terminals 261, in which the terminals that extend in the longitudinal direction of the frame members 271 are arranged in the lateral direction of the frame members 271 orthogonal to the longitudinal direction, are mutually juxtaposed at the predetermined pitch, and are integrally connected to the frame member 271 via the sub-carrier portion 273 including the slits 274. Subsequently, the preliminarily formed terminal product 270 is coated with the molding material due to over-molding to form the terminal holding member 231 which coats at least a part of the sub-carrier portion 273. Finally, a part of the sub-carrier portion 273, that is to say, the cut portions 279 to cut the first terminal connecting portion 273*a* and the second terminal connecting portion 273*b* are formed. Moreover, the terminal sub-carrier portion 273 is cut to independently separate the terminals 261 from one another. Therefore, the frame member 271 and all the terminals 261 can be integrally formed. Thus, the terminal assembly 260 can easily be produced in a reduced time. Even if the pitch of the terminals 261 is a micro value of, for example, about 100 μm or less, the arrangement of the terminals 261 can accurately be maintained. Similarly, a positional relation between the terminals 261 and the frame member 271 can accurately be maintained.

Figure 15:
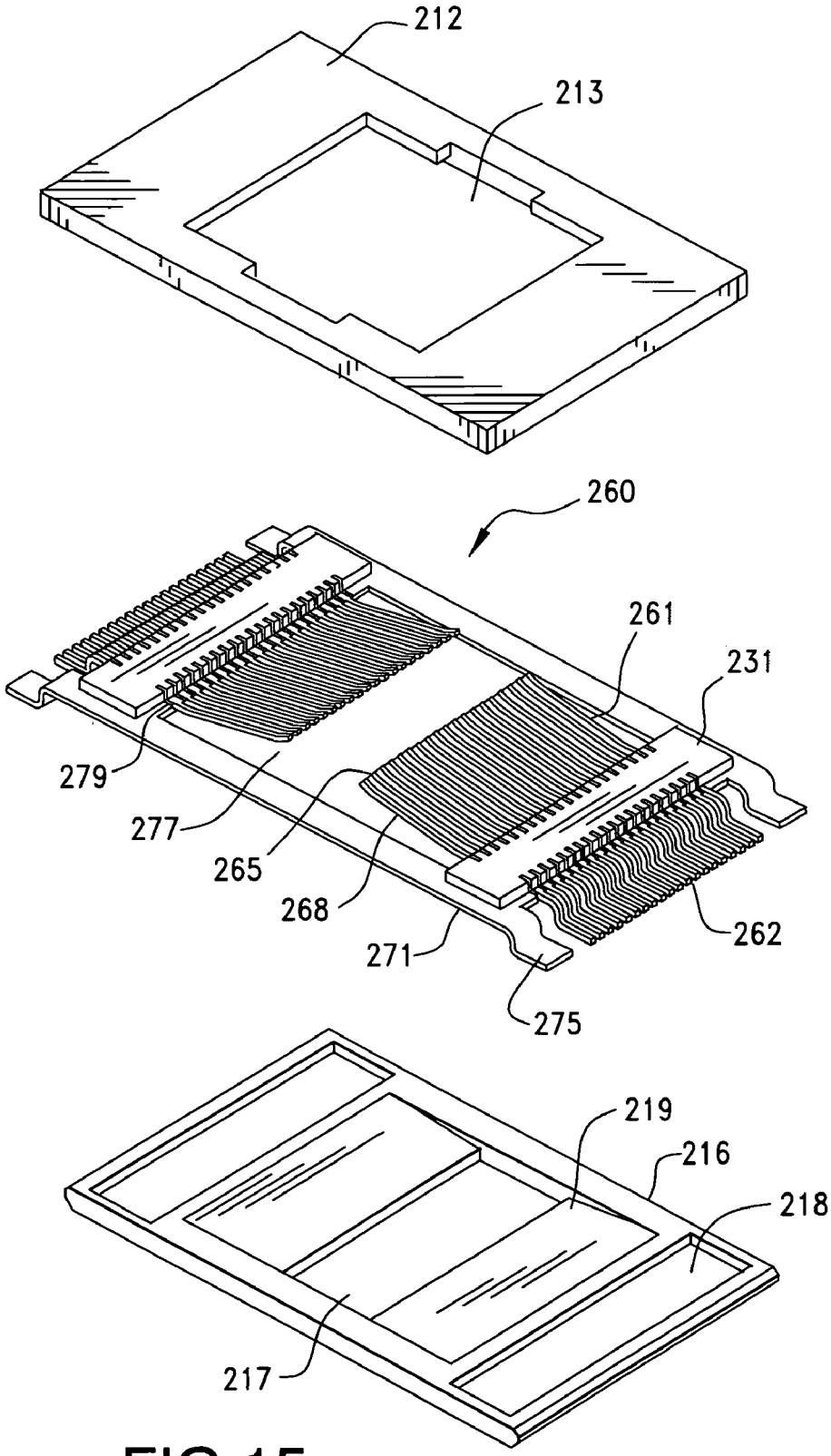
FIG. 15 is an exploded perspective view of the connector according to the third embodiment.

As shown in FIG. 15, when the terminal assembly 260 is vertically nipped or grasped between the upper half part 212 and the lower half part 216 of the housing 211, the connector 201 can be completed as shown in FIGS. 101. It is noted that the upper half part 212 and the lower half part 216 are secured to upper and lower surfaces of the terminal assembly 260 by an arbitrary but suitable securing means such as an adhesive.

Next, an operation of fitting the connector 201 into the counterpart connector 301 to connect the terminals 261 to the counterpart terminals 361 of this third embodiment is described. With reference to FIGS. 16-22. FIG. 22 provide a series of diagrammatic views showing the effects of the contact and mating forces during the operation of fitting the connector into the counterpart connector according to the third embodiment of the Present Disclosure, in which FIGS. 22A, C, E and G show a progression of the connector mating with the terminal assembly from the point of first contact through the point of full mating; FIGS. 22B, D, F and H show the force vectors of the contact and mating forces at the point in which the terminal is in contact with the connector; and FIG. 23 is a series of perspective views showing an operation of fitting the connector into the counterpart connector according to the third embodiment of the Present Disclosure, in which FIG. 23A corresponds to FIG. 17, FIG. 23B corresponds to FIG. 18 and FIG. 23C corresponds to FIG. 19.

Figure 16:
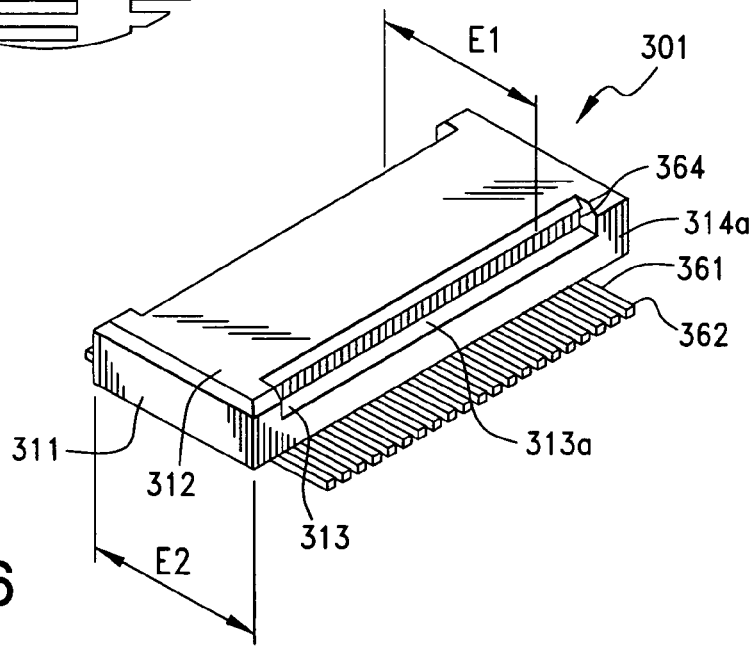
FIG. 16 is a perspective view of the counterpart connector according to the third embodiment.
Figure 13A:
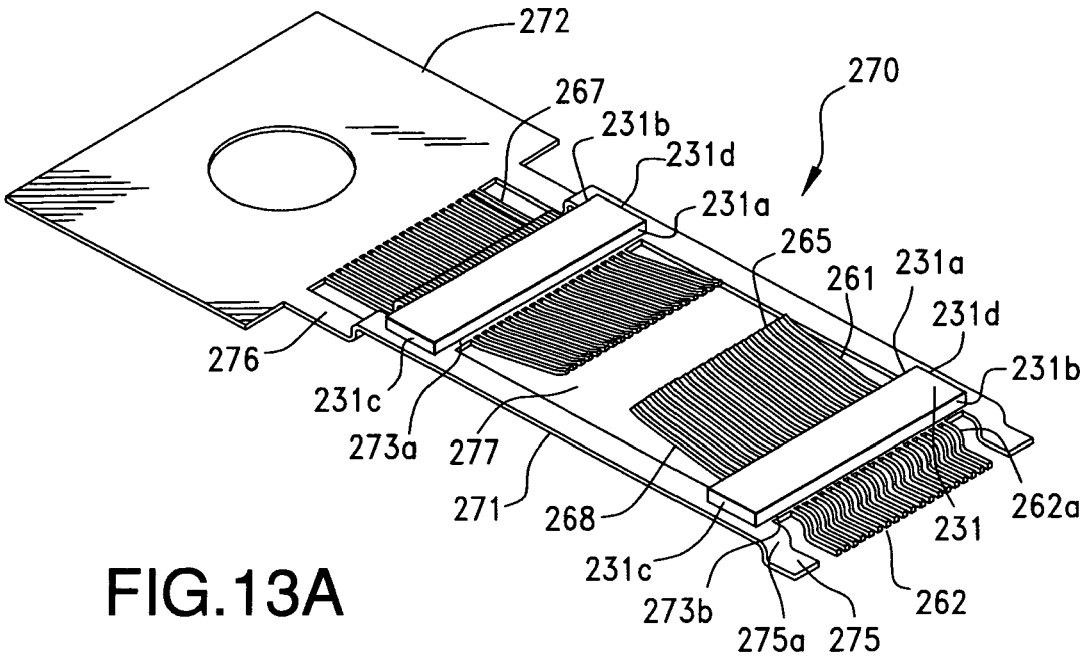
FIG. 13A is a second perspective view.
Figure 13B:
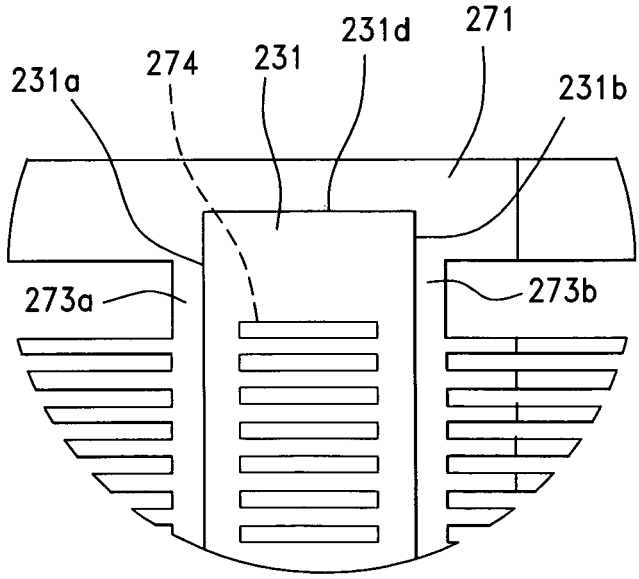
FIG. 13B is an enlarged view of the main part.

In the embodiment as shown in FIG. 16, the counterpart connector 301 has a counterpart housing 311 formed of an insulating material such as a synthetic resin, and a plurality of counterpart terminals 361 made of a conductive metal. As shown in FIG. 16, the counterpart housing 311 has a rectangular parallelepiped thick-plate-like shape, and recessed portions 313 each having a rectangular section and extending along a longitudinal direction of a rectangular tip end surface 312 are formed at corner edge portions on opposite sides of the rectangular tip end surface 312. Each recessed portion 313 is provided with a pressing surface 313*a* substantially parallel to the tip end surface 312 and holding portions 313*b* which hold the counterpart terminals 361 in a direction orthogonal to the tip end surface 312. The counterpart terminals 361 are inserted in openings 311*a* disposed at the counterpart housing 311, and held by the holding portions 313*b*.

Moreover, the counterpart terminals 361 are elongated strip-like members each substantially having an L-shape formed by bending an intermediate portion of the member at right angles. Furthermore, a portion of each counterpart terminal 361 extending in the thickness direction of the counterpart housing 311 is buried and held in the counterpart housing 311. A portion of the counterpart terminal 361 in the vicinity of a tip end of the counterpart terminal 361 is disposed as the counterpart contact portion 364 along the surface of the recessed portion 313 extending in the thickness direction of the counterpart housing 311. That is, the counterpart contact portions 364 are exposed at the recessed portion 313. Furthermore, portions of the counterpart terminals 361 extending in the width direction of the counterpart housing 311 are counterpart tail portions 362 as soldered portions protruding outwards from opposite sides of a lower surface of the counterpart housing 311. It is noted that the counterpart tail portions 362 are connected to the surface of a counterpart circuit substrate 391 by soldering or the like, and lower end surfaces of the counterpart tail portions 362 are disposed to be substantially even with the lower surface of the counterpart housing 311.

Typically, a width "E2" of the counterpart housing 311 in the lateral direction thereof is larger than the interval "L1". Owing to a difference between the width "E2" and the interval "E1", the pressing surfaces 313*a* on the opposite sides are formed. When the counterpart connector 301 is attached to the connector 201, the tip end portions 265 of the terminals 261 facing each other are pressed together.

Figure 18:
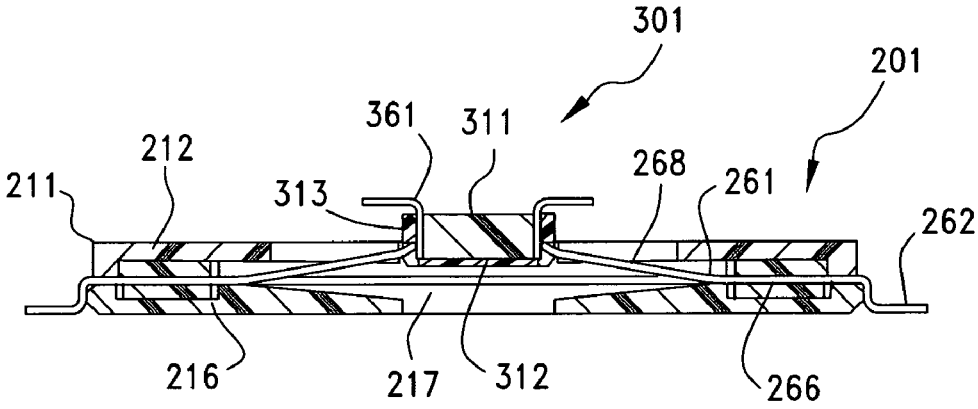
FIG. 18 is a second diagrammatic view showing the operation of fitting the connector into the counterpart connector according to the third embodiment.
Figure 19:
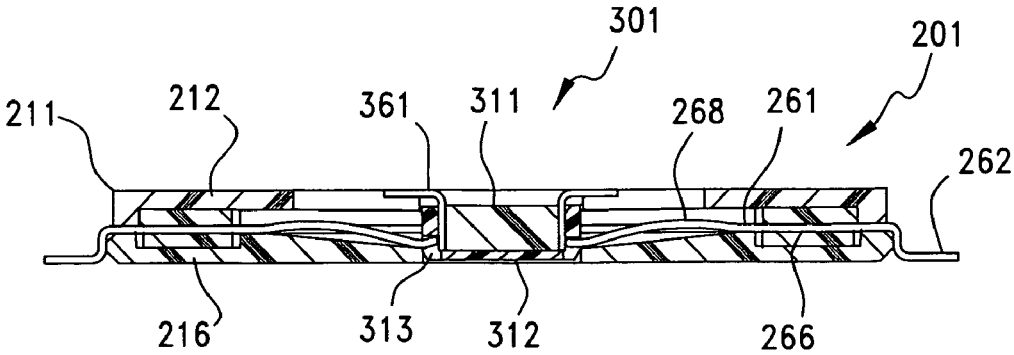
FIG. 19 is a third diagrammatic view showing the operation of fitting the connector into the counterpart connector according to the third embodiment.
Figure 20:
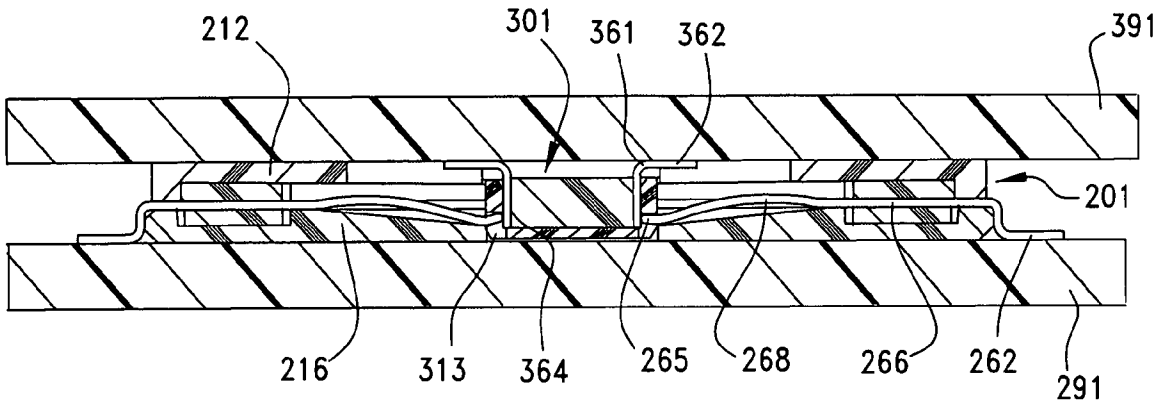

As shown in FIG. 20, the connector 201 is mounted on the surface of the circuit substrate 291, and the counterpart connector 301 is mounted on the surface of the counterpart circuit substrate 391. It is noted that in FIGS. 17-9, for the sake of convenience of description, the circuit substrate 291 and the counterpart circuit substrate 391 are omitted from the drawings. A section of the connector 201 shown in FIGS. 17-20 is similar to that of the portion shown in FIG. 11C.

Figure 17:
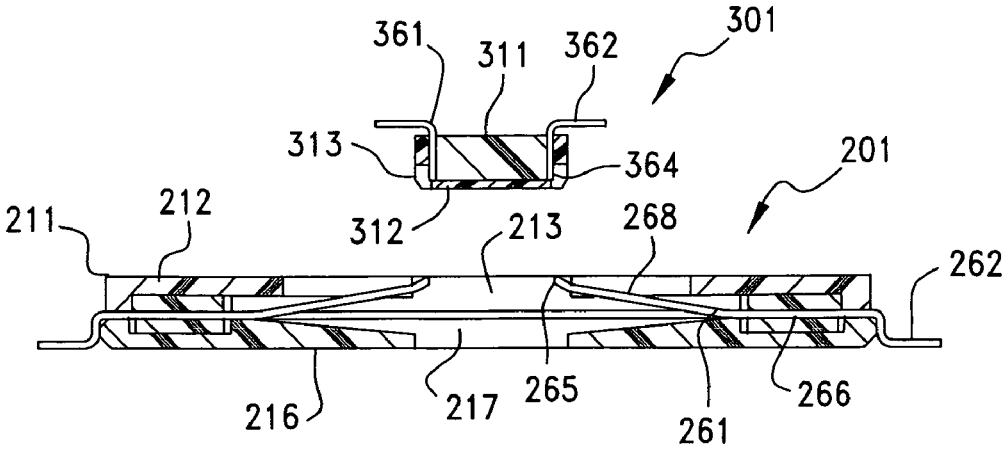
FIG. 17 is a first diagrammatic view showing an operation of fitting the connector into the counterpart connector according to the third embodiment.

Moreover, when the connector 201 is fitted into the counterpart connector 301, postures of the connector 201 and the counterpart connector 301 are adjusted to allow the upper surface of the upper half part 212 of the housing 211 to face the tip end surface 312 of the counterpart housing 311 as shown in FIG. 17. At this time, the postures of the connector 201 and the counterpart connector 301 are adjusted so that the upper surface of the upper half part 212 of the housing 211 is disposed in parallel with the tip end surface 312 of the counterpart housing 311, the longitudinal direction of the housing 211 is orthogonal to the counterpart housing 311, and the expanded portion 213*a* of the upper opening 213 of the upper half part 212 of the housing 211 and the lower opening 217 of the lower half part 216 correspond to the counterpart connector 301.

Furthermore, the connector 201 and/or the counterpart connector 301 is moved toward a counterpart side. As shown in FIG. 18, the tip end surface 312 of the counterpart housing 311 is allowed to enter the upper opening 213 of the upper half part 212 of the housing 211. At this time, the tip end portions 265 of the terminals 261 extend so as to be directed from the opposite sides of the housing 211 to the center of the housing 211 in the longitudinal direction and so as to angle upwards are allowed to enter the recessed portion 313 of the counterpart housing 311 to engage the tip end portions 265 with the recessed portion 313. Since the tip end portion 265 is angled upwards from the arm portion 268 and connected to the arm portion 268, the tip end portion 265 securely engages with the recessed portion 313. Even when the counterpart connector 301 moves downwards, the tip end portion 265 does not disengage from the recessed portion 313.

Subsequently, when the connector 201 and/or the counterpart connector 301 is further moved, the tip end portions 265 are moved downwards by the surface of the recessed portion 313 substantially extending in parallel with the tip end surface 312. At this time, the arm portions 268 angle upwards. Therefore, when the tip end portions 265 move downwards, the interval between the tip end portions 265 on the opposite sides is reduced, and the tip end portions 265 are pressed against the counterpart contact portions 364 arranged along the surface of the recessed portion 313 extending in the thickness direction of the counterpart housing 311. Moreover, when the tip end portions 265 receive reactive forces from the counterpart contact portions 364, the arm portions 268 are elastically deformed. In this case, the tip end portions 265 receive, from the counterpart contact portions 364, a force to press the arm portions 268 in the longitudinal direction. The arm portions 268 receive the pressing force in the longitudinal direction, and are elastically deformed.

On the other hand, since the deformed arm portions 268 exert a spring force, the tip end portions 265 are urged toward the counterpart contact portions 364 by the spring force. In this case, the spring force of the arm portions 268 applied from the tip end portions 265 to the counterpart connector 301 is exhibited substantially in a direction corresponding to an extension direction of the arm portions 268. Therefore, when the tip end portions 265 are substantially positioned above the base end portions 266, the spring force of the arm portions 268 applied from the tip end portions 265 to the counterpart connector 301 is decomposed into a force having a direction vertical to the counterpart contact portions 364; namely, a horizontal component directed from the opposite sides to the center of the counterpart connector 301 and a force having a direction vertical to the surface of the recessed portion 313 substantially extending in parallel with the tip end surface 312; namely, a vertical component directed so as to press the counterpart connector 301 upwards.

Moreover, when the connector 201 and/or the counterpart connector 301 is further moved, as shown in FIGS. 19-20, the connector 201 is completely fitted into the counterpart connector 301, and the terminals 261 are completely connected to the counterpart terminals 361. In this state, since the counterpart circuit substrate 391 abuts against the upper half part 212 of the housing 211, the counterpart connector 301 cannot further move downwards.

Furthermore, since the tip end portions 265 are substantially positioned below the base end portions 266, the vertical component of the spring force of the arm portions 268 applied from the tip end portions 265 to the counterpart connector 301; namely, a component of the spring force of the arm portions 268 in the movement direction of the counterpart connector 301 or the counterpart terminals 361 has such a direction as to depress the counterpart connector 301 downwards. Therefore, since the connector 201 is securely fitted into the counterpart connector 301 by a downward component of the force applied from the tip end portions 265 to the counterpart connector 301, the connector 201 and the counterpart connector 301 are brought into a state similar to a locked state without adding any special lock mechanism.

The tip end portions 265 are bend so that the contacts 265*a* of the tip end portions 265 are further directed upwards from the arm portions 268, and connected to the arm portions 268 beforehand. In this case, even when the counterpart connector 301 moves downwards, the contacts 265*a* are positioned on the side of a pressing surface 313*a*, and the portions other than the contacts 265*a* can be prevented from being brought into contact with the pressing surface 313*a*. Therefore, a length of the counterpart contact portion 364 can be reduced, and the tip end portions 265 can more securely be engaged with the recessed portion 313.

Figure 21:
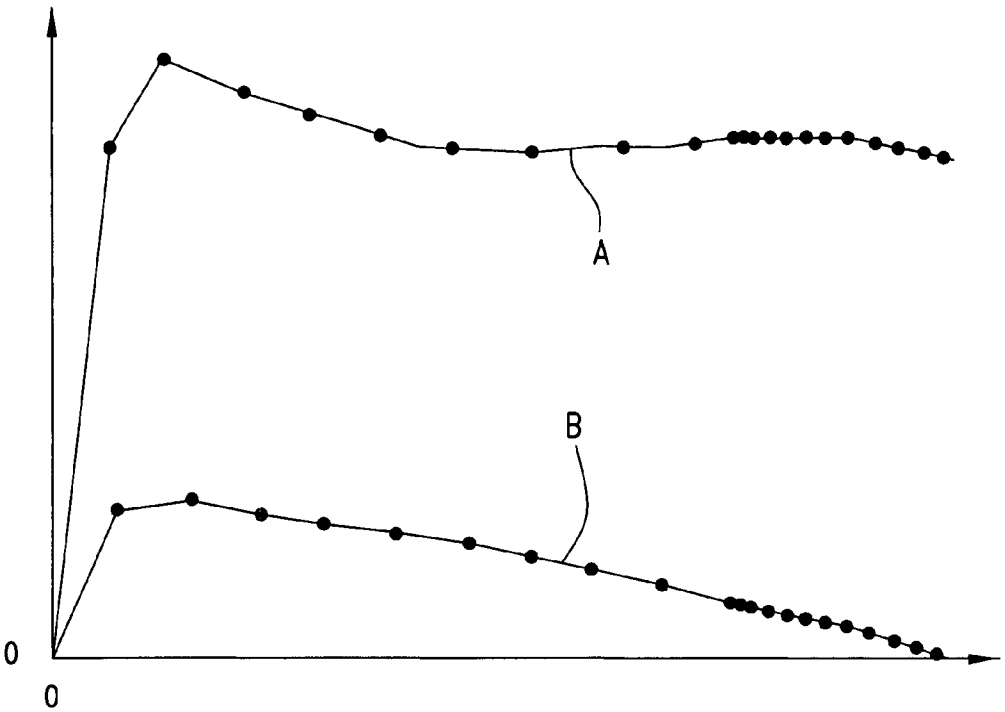
FIG. 21 is a graph showing a change of a force in a case where the connector is fitted into the counterpart connector according to the third embodiment.

When the connector 201 is fitted into the counterpart connector 301, the force applied from the tip end portions 265 to the counterpart connector 301 changes as shown in FIG. 21. In FIG. 21, the abscissa indicates an amount of downward displacement of the counterpart connector 301 with respect to the connector 201, and the ordinate indicates a magnitude of the force applied from the tip end portions 265 to the counterpart connector 301. Moreover, a curve "A" indicates a component applied from the tip end portions 265 of the terminals 261 to the counterpart connector 301 and having a direction vertical to the counterpart contact portions 364, to namely a change of a contact force between the terminals 261 and the counterpart contact portions 364. Curve "B" indicates a component applied from the tip end portions 265 of the terminals 261 to the counterpart connector 301 and having such a direction as to push up the counterpart connector 301, namely, a change of a push-in force required for each terminal 261 in moving the connector 201 and/or the counterpart connector 301 toward the counterpart side.

As described above, the spring force of the arm portions 268 applied from the tip end portions 265 to the counterpart connector 301 is exhibited substantially in a direction corresponding to an extension direction of the arm portions 268. Therefore, when an angle of the arm portions 268 changes with the downward displacement of the counterpart connector 301 with respect to the connector 201, the component of the spring force of the arm portions 268 applied from the tip end portions 265 to the counterpart connector 301 in the movement direction of the counterpart connector 301 or the counterpart terminals 361 changes. Therefore, as shown by the curve "B", the push-in force decreases, when the downward displacement of the counterpart connector 301 with respect to the connector 201 goes beyond a certain point. Therefore, an operator can have a feeling similar to a feeling of click generated during an operation of a tactile switch, when the connector 201 is fitted into the counterpart connector 301.

Moreover, since an angle that the arm portions 268 extend in the horizontal direction is much smaller than 45 degrees, the horizontal component of the spring force of the arm portions 268 applied from the tip end portions 265 to the counterpart connector 301 is remarkably larger than the vertical component. Therefore, as shown by the curve "A", the contact force between the terminals 261 and the counterpart contact portions 364 is remarkably larger than the push-in force. That is, even if an only small push-in force is required, a large contact force can be obtained.

As described above, when the tip end portions 265 are positioned below the base end portions 266, the component of the force in the movement direction of the counterpart connector 301 or the counterpart terminals 361 is a minus component. Curve "B" shown in the graph of FIG. 21 indicates that, when the tip end portions 265 are positioned slightly below the base end portions 266, the component in the movement direction substantially changes from the minus component to zero and that the push-in force of the counterpart connector 301 becomes zero.

It is noted that in a case where it is assumed that the tip end portions 265 can further be displaced downwards, the counterpart connector 301 is positioned below owing to the downward component of the force applied from the tip end portions 265 to the counterpart connector 301, and the fitted state of the connector 201 is stabilized. However, the contact force between the terminals 261 and the counterpart terminals 361 weakens. Therefore, it is preferable that a downward movement amount of the tip end portions 265 is set to be smaller than an upward movement amount.

Figure 20A:
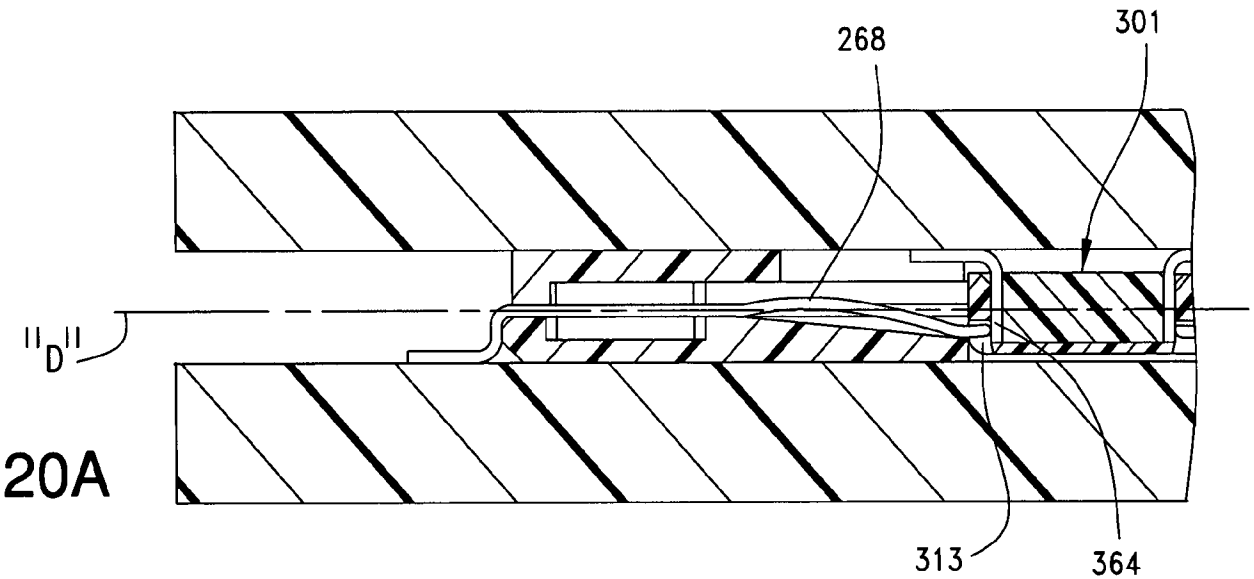

FIG. 22B indicates that right when the tip end portions 265 come into contact with the counterpart connector 301, the contact force and the mating force are essentially zero. FIG. 22D indicates that as the counterpart connector 301 is pushed down into the connector 201, there is a mating force in the upward direction and a contact force in the longitudinal direction. FIG. 22F indicates that when the tip end portions 265 reach a vertical point indicated by a datum line "D" (also shown in FIG. 20A), the vertical mating force drops to zero and the contact force reaches a maximum in the longitudinal direction. FIG. 22H indicates that when the tip end portions 265 go below the datum line "D", a vertical mating force occurs in the downward direction and the contact force is maintained in the longitudinal direction. Therefore, when the tip end portions 265 are above the datum line the counterpart connector 301 is urged in the upward vertical direction by the mating force. Further, when the tip end portions 265 are below the datum line the counterpart connector 301 is urged in the downward vertical direction by the mating force, essentially holding the connectors together.

Furthermore, as described above, the arm portions 268 receive the pressing force in the longitudinal direction and are elastically deformed. Therefore, as compared with a case where the arm portions 268 are deformed in the vertical direction, a large spring force is exerted. Therefore, even when the terminals 261 are elongated strip-like members, a sufficiently large contact force can be exerted. For example, in order to arrange the terminals 261 at a pitch of about 100 μm, a width of each terminal 261 cannot be chosen to be about 50 μm or more from a viewpoint of the working of the metal plate. However, in the present embodiment, since the arm portions 268 receive the pressing force in the longitudinal direction and are elastically deformed, it is calculated that a contact force of about 40 [gf] for each terminal 261 can be exerted.

In the present embodiment, it has been described that the housing 211 is attached to the terminal assembly 260 to manufacture the connector 201 and the connector 201 is fitted into the counterpart connector 301, but the terminal assembly 260 may be used without being attached to the housing 211. For example, the terminal assembly 260 may be mounted on the surface of the circuit substrate 291 as it is. Alternatively, a recessed portion may be formed in the surface of the circuit substrate 291, and the terminal assembly 260 may be mounted so as to store the terminal assembly 260 in the recessed portion. In such a case, the stepped portions 275*a* and 262*a* may be omitted, and the attaching portion 275 and the tail portion 262 may be disposed to be even with the frame member 271 and the base end portions 266 of the terminals 261. Attaching portion 275 functions as a foot that provides grounding when in use and, during production, helps to hold the terminals 261 in place, when singulated and when completed.

As described above, in the present embodiment, the preliminarily formed terminal product 270 is formed. The preliminarily formed terminal product 270 has the terminals 261 which are arranged at the predetermined pitch in parallel with one another between a pair of frame members 271 and which are integrally connected to one another via the sub-carrier portion 273 and which are connected to the frame members 271. Moreover, the preliminarily formed terminal product 270 is formed by over-molding so as to form the terminal holding member 231 which coats at least a part of the sub-carrier portion 273. Next, a part of the sub-carrier portion 273 and a part of the terminal holding member 231 are both cut to independently separate the terminals 261 from one another. Therefore, the terminal assembly 260 is obtained. Therefore, even if the terminals 261 are arranged at a small pitch, the terminal assembly 260 and the connector 201 can easily be manufactured in a reduced time. It is possible to obtain the miniaturized terminal assembly 260 and connector 201 in which the arrangement of the terminals 261 can accurately be maintained.

Moreover, each terminal 261 includes the base end portion 266, the elastically deformable arm portion 268 extending from the base end portion 266 and the tip end portion 265 which is arranged at the free end of the arm portion 268 to come into contact with the counterpart terminal 361 of the counterpart connector 301. The tip end portion 265 is configured to receive the pressing force of the terminal 261 in the longitudinal direction. Therefore, it is possible to obtain the terminal assembly 260 and the connector 201 in which, in spite of a simple structure, a sufficient spring force is exerted so that the terminals constantly keep in contact with the counterpart terminals 361. Moreover, the counterpart terminals 361 can securely be held. The pitch of the terminals 261 can be reduced, and height dimensions of the terminal assembly 260 and the connector 201 can be reduced. Furthermore, the terminal assembly 260 and the connector 201 can easily be manufactured, costs can be curtailed, and miniaturization of the whole size can be achieved.

Moreover, the arm portions 268 are formed so as to be directed toward one side in the longitudinal direction of the frame members 271; namely, angled upwards, before connected to the counterpart terminals 361. When the terminals are completely connected to the counterpart terminals 361, the arm portions 268 are directed toward the other side in the longitudinal direction of the frame member 271; namely, angled downwards. Furthermore, the tip end portions 265 apply, to the counterpart terminals 361, the spring force which is, exerted at a time when the terminals 261 receive the pressing force in the longitudinal direction and are elastically deformed. The component of the spring force in the movement direction of the counterpart terminals 361 has the same direction as that of the movement direction of the counterpart terminals 361, when the terminals are completely connected to the counterpart terminals 361.

Therefore, since the arm portions 268 receive the pressing force in the longitudinal direction and are elastically deformed, a large spring force is exerted. The tip end portions 265 are urged with respect to the counterpart terminals 361 with a large spring force, and the terminals 261 can securely electrically be connected to the counterpart terminals 361. The connector 201 can securely be fitted into the counterpart connector 301 by the component of the force applied from the tip end portions 265 to the counterpart connector 301 in the movement direction of the counterpart terminals 361.

It is noted that in the first and third embodiments, the terminals 61, 261 have substantially the same shape and are all connected to the sub-carrier portions 73, 273. However, the Present Disclosure is not limited to the embodiments, and a predetermined combination may be connected. The terminal holding members 31, 231 are formed of a rectangular parallelepiped resin molded material, but the shapes of the terminal holding members 31, 231 may appropriately be determined in accordance with the arrangements of the sub-carrier portions 73, 273, the shapes of the terminals 61, 261 and the like.

Furthermore, the Present Disclosure is not limited to the above-described embodiments, and may be changed in various ways based on the gist of the Present Disclosure, and these changes are not eliminated from the scope of the Present Disclosure.

What is claimed is:

1. A terminal assembly, the terminal assembly comprising:
- a plurality of frame members;
- a plurality of terminals, the terminals being arranged at a predetermined pitch and in parallel with one another; and
- a terminal holding member, the terminal holding member being connected to the frame members to secure the terminals;
- wherein each terminal includes:
  - a base end portion being held by the terminal holding member, each base end portion being separated from a proximate base portion by a slit;
  - an elastically deformable arm portion extending from the base end portion; and
  - a tip end portion, the tip portion being arranged at a free end of the arm portion to be capable of coming into contact with a counterpart terminal and configured to receive a pressing force of the counterpart terminal in a longitudinal direction thereof.

2. The terminal assembly according to claim 1, wherein each frame member comprises a pair of members which extend in parallel with each other.

3. The terminal assembly according to claim 2, wherein each terminal includes two sets of terminals arranged between the frame members on opposite sides, so that the base end portions are positioned on opposite sides of the frame members in the longitudinal direction and that the tip end portions are directed to centers of the frame members in the longitudinal direction.

4. The terminal assembly according to claim 3, wherein the terminal holding member includes a pair of members extending in parallel with each other.

5. The terminal assembly according to claim 4, wherein the pair of members of the terminal holding member are connected to the frame members at opposite ends thereof in the longitudinal direction.

6. The terminal assembly according to claim 1, wherein the terminal holding member is formed of an over-molded insulating material which coats a portion of both the base end portions and the frame members.

7. The terminal assembly according to claim 1, wherein each arm portion is angled toward one side thereof in the longitudinal direction of the frame members before contact with the counterpart terminal.

8. The terminal assembly according to claim 4, wherein each tip end portion applies, to the counterpart terminal, a spring force exerted when the tip end portion receives the pressing force of the counterpart terminal in the longitudinal direction and is elastically deformed.

9. The terminal assembly according to claim 8, wherein a component of the spring force, in a movement direction of the counterpart terminal, has the same direction as the movement direction of the counterpart terminal when the terminal is in contact with the counterpart terminal.

10. The terminal assembly according to claim 1, wherein the predetermined pitch is approximately between 0.1 and 0.2 mm on a center-to-center basis between adjacent terminals.

11. A connector comprising:
- a housing; and
- a plurality of terminals, the terminals being arranged at a predetermined pitch parallel with one another;

wherein each terminal includes:

a base end portion being held by the housing, each base end portion being separated from a proximate base end portion by a slit;

an elastically deformable arm portion extending from the base end portion; and a tip end portion, the tip portion being arranged at a free end of the arm portion to come into contact with a counterpart terminal of a counterpart connector and configured to receive a pressing force of the counterpart terminal in a longitudinal direction thereof.

12. The connector according to claim 11, wherein the housing comprises an opening formed at the center thereof in the longitudinal direction and into which the counterpart connector is fitted.

13. The connector according to claim 12, wherein each terminal further include two sets of terminals arranged so that the base end portions are positioned on opposite sides of the housing in the longitudinal direction and that the tip end portions are directed to the center of the housing in the longitudinal direction and positioned in the opening.

14. The connector according to claim 11, wherein each arm portion is angled toward one side thereof in the longitudinal direction of the housing before being fitted to the counterpart connector.

15. The connector according to claim 14, wherein the tip end portion applies, to the counterpart terminal, a spring force exerted when the terminal receives the pressing force in the longitudinal direction and is elastically deformed.

16. The connector according to claim 15, wherein a component of the spring force, in a movement direction of the counterpart connector, has the same direction as the movement direction of the counterpart connector when the connector is in contact with the counterpart connector.

* * * * *